US009766015B2

(12) United States Patent
Matsuura et al.

(10) Patent No.: US 9,766,015 B2
(45) Date of Patent: Sep. 19, 2017

(54) HEAT EXCHANGER

(71) Applicant: Panasonic Intellectual Property Management Co., Ltd., Osaka-shi, Osaka (JP)

(72) Inventors: Takahiro Matsuura, Osaka (JP); Tomoichiro Tamura, Kyoto (JP); Bunki Kawano, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 222 days.

(21) Appl. No.: 14/783,046

(22) PCT Filed: Apr. 3, 2014

(86) PCT No.: PCT/JP2014/001948
§ 371 (c)(1),
(2) Date: Oct. 7, 2015

(87) PCT Pub. No.: WO2014/171095
PCT Pub. Date: Oct. 23, 2014

(65) Prior Publication Data

US 2016/0054068 A1 Feb. 25, 2016

(30) Foreign Application Priority Data

Apr. 16, 2013 (JP) ..... 2013-085731
May 31, 2013 (JP) ..... 2013-115907

(51) Int. Cl.
*F28F 3/12* (2006.01)
*F28D 1/053* (2006.01)
(Continued)

(52) U.S. Cl.
CPC ..... *F28D 1/05375* (2013.01); *F28D 1/0341* (2013.01); *F28F 9/02* (2013.01); *F28F 2270/00* (2013.01)

(58) Field of Classification Search
CPC .. F28D 1/05375; F28D 1/0341; F28D 1/0333; F28F 9/02; F28F 2270/00
(Continued)

(56) References Cited

U.S. PATENT DOCUMENTS 5,042,577 A * 8/1991 Suzumura ..... B23K 1/0012 165/153
5,137,082 A * 8/1992 Shimoya ..... F25B 39/022 165/110
(Continued)

FOREIGN PATENT DOCUMENTS

CN 101691961 A 4/2010
CN 102748979 10/2012
(Continued)

OTHER PUBLICATIONS

Supplementary partial European Search Report issued in corresponding European Patent Application No. 14785370.9, Apr. 18, 2016, 7 pages.
(Continued)

*Primary Examiner* — Claire Rojohn, III
(74) *Attorney, Agent, or Firm* — Hamre, Schumann, Mueller & Larson, P.C.

(57) ABSTRACT

It is aimed to reduce the size of heat exchange tubes and also to reduce pressure loss of a fluid flowing in an external flow path formed between adjacent heat exchange tubes. A first projecting portion 41 and a second projecting portion 42 of a first heat exchange tube 2A are joined to portions around an inlet 3C and outlet 3D of a second heat exchange tube 2B. A first flow path forming portion 61, a second flow path
(Continued)

forming portion 62, and a third flow path forming portion 63 of an internal flow path 3 of each of the first heat exchange tube 2A and the second heat exchange tube 2B face a first thin portion 21A and a second thin portion 21B of the second heat exchange tube 2B or the first heat exchange tube 2A across an external flow path 4. The first flow path forming portions 61, the second flow path forming portions 62, and the third flow path forming portions 63 of the first heat exchange tube 2A and the second heat exchange tube 2B are arranged in a staggered pattern in a width direction of the heat exchange tubes 2.

11 Claims, 27 Drawing Sheets

(51) Int. Cl.
*F28D 1/03* (2006.01)
*F28F 9/02* (2006.01)

(58) Field of Classification Search
USPC ..... 165/167
See application file for complete search history.

(56) References Cited

U.S. PATENT DOCUMENTS 5,447,194 A * 9/1995 Hayashi ..... B60H 1/3227 165/149
5,553,664 A * 9/1996 Nishishita ..... F28D 1/0341 165/153
5,649,592 A * 7/1997 Nishishita ..... F28D 1/0341 165/153
5,810,077 A * 9/1998 Nakamura ..... F25B 39/024 165/153
6,397,938 B1 * 6/2002 Nishishita ..... F28D 1/0341 165/153
6,516,486 B1 * 2/2003 Mehendale ..... F28D 1/0333 165/153
6,520,251 B2 * 2/2003 Shin ..... F28D 1/0341 165/153
6,666,263 B2 * 12/2003 Luz ..... F28D 9/0043 165/153
7,367,386 B2 * 5/2008 Sato ..... F01M 5/002 165/153
2003/0164233 A1 * 9/2003 Wu ..... F28D 1/0308 165/166
2006/0237178 A1 10/2006 Katoh et al.
2006/0254752 A1 11/2006 Narakono et al.
2008/0105416 A1 5/2008 Katoh et al.
2015/0184946 A1 * 7/2015 Barwig ..... F02M 26/32 123/542

FOREIGN PATENT DOCUMENTS

JP 01-193589 8/1989
JP 06-106335 4/1994
JP 10-227544 8/1998
JP 11-153395 6/1999
JP 11-257877 9/1999
JP 2001-012888 1/2001
JP 2006084078 A 3/2006
JP 2006-207948 8/2006
JP 2006-322698 11/2006
JP 2008-039322 2/2008
JP 2008039322 A * 2/2008
JP 2008-116102 5/2008
JP 2008-190775 8/2008
JP 4451981 2/2010

OTHER PUBLICATIONS

Search Report for Chinese Application No. 201480020483.X, dated Oct. 21, 2016, 4 pages including English translation.
International Search Report of PCT/JP2014/001948, dated Jul. 8, 2014, and English translation thereof, 4 pages total.
Office Action issued for corresponding European Patent Application No. 14785370.9, dated Jun. 12, 2017, 5 pages.

* cited by examiner

HEAT EXCHANGER

TECHNICAL FIELD

The present invention relates to heat exchangers.

BACKGROUND ART

Patent Literature 1 discloses a heat exchanger 301 which, as shown in FIG. 12, has heat exchange tubes 302. The heat exchange tube 302 is fabricated by subjecting one plate material to bending process so as to form a central portion 302A in a flat tubular shape and form, at both ends, widened portions 302B and 302C each having an opening and having a thickness about two to four times the thickness of the central portion 302A. Patent Literature 1 also states that the heat exchange tube 302 may have a winding refrigerant flow path and that the winding refrigerant flow path may be divided by a space.

Patent Literature 2 describes a method of producing an element for a laminated evaporator, wherein a metal plate 401 which, as shown in FIG. 13, has a first recess 402A, a second recess 402B, and a partition 403 is folded along a center line X and then the two halves are bonded together.

Patent Literature 3 discloses a heat exchange tube 510 which, as shown in FIG. 14 and FIG. 15, is formed by joining together a pair of upper and lower plate-shaped members 503A and 503B each of which is provided with semicircular or elliptical recesses 501 and flat portions 502 which are alternately arranged, the heat exchange tube 510 having a shape formed of tubes 511 and ribs 512 connecting the tubes 511 together. Patent Literature 3 also states that, as shown in FIG. 15, adjacent heat exchange tubes 510 may be displaced from each other alternately in upward and downward directions so that the heat exchange tubes 510 are arranged in a staggered pattern.

CITATION LIST

Patent Literature

Patent Literature 1: JP 2008-39322 A
Patent Literature 2: JP 6(1994)-106335 A
Patent Literature 3: JP 4451981 B

SUMMARY OF INVENTION

Technical Problem

The technique disclosed in Patent Literature 1 enables reduction in size and weight of a heat exchanger. The technique disclosed in Patent Literature 2 enables inexpensive production of a laminated evaporator (heat exchanger) with good performance. The technique disclosed in Patent Literature 3 enables, at low cost, reduction in pressure loss of an air stream flowing in an external flow path formed between adjacent heat exchange tubes. However, novel proposals for surpassing the techniques disclosed in Patent Literature 1 to 3 have been desired.

The present invention aims to reduce the size of heat exchange tubes and also to reduce pressure loss of a fluid flowing in an external flow path formed between adjacent heat exchange tubes.

Solution to Problem

That is, the present disclosure provides a heat exchanger including a plurality of heat exchange tubes each including an internal flow path in which a first fluid flows, an inlet of the internal flow path, and an outlet of the internal flow path, the heat exchange tubes being assembled so as to form an external flow path for a second fluid to be heat-exchanged with the first fluid, wherein the internal flow path includes a plurality of segments extending in a given row direction of the heat exchange tube, the heat exchange tube is constituted by a pair of plate members bonded together so as to form the internal flow path, the heat exchange tube further including: (i) a plurality of flow path forming portions projecting to both sides in a thickness direction of the heat exchange tube and respectively forming the segments of the internal flow path; (ii) a thin portion located between the flow path forming portions adjacent to each other in a width direction orthogonal to the row direction, the thin portion separating the segments of the internal flow path from each other along the row direction; (iii) a first projecting portion formed around the inlet of the internal flow path and projecting in the thickness direction of the heat exchange tube; and (iv) a second projecting portion formed around the outlet of the internal flow path and projecting in the thickness direction of the heat exchange tube, when two adjacent ones of the heat exchange tubes are defined as a first heat exchange tube and a second heat exchange tube, respectively, the first projecting portion of the first heat exchange tube is joined to a portion around the inlet of the second heat exchange tube, and the second projecting portion of the first heat exchange tube is joined to a portion around the outlet of the second heat exchange tube, in a cross-section perpendicular to the row direction, the flow path forming portion of the first heat exchange tube faces the thin portion of the second heat exchange tube across the external flow path, and the flow path forming portion of the second heat exchange tube faces the thin portion of the first heat exchange tube across the external flow path, and the flow path forming portions of the first heat exchange tube and the second heat exchange tube are arranged in a staggered pattern in the width direction.

Advantageous Effects of Invention

According to this disclosure, the size of the heat exchanger can be reduced, and the pressure loss of the fluid flowing in the external flow path formed between the adjacent heat exchange tubes can also be reduced.

DESCRIPTION OF EMBODIMENTS

Figure 12:
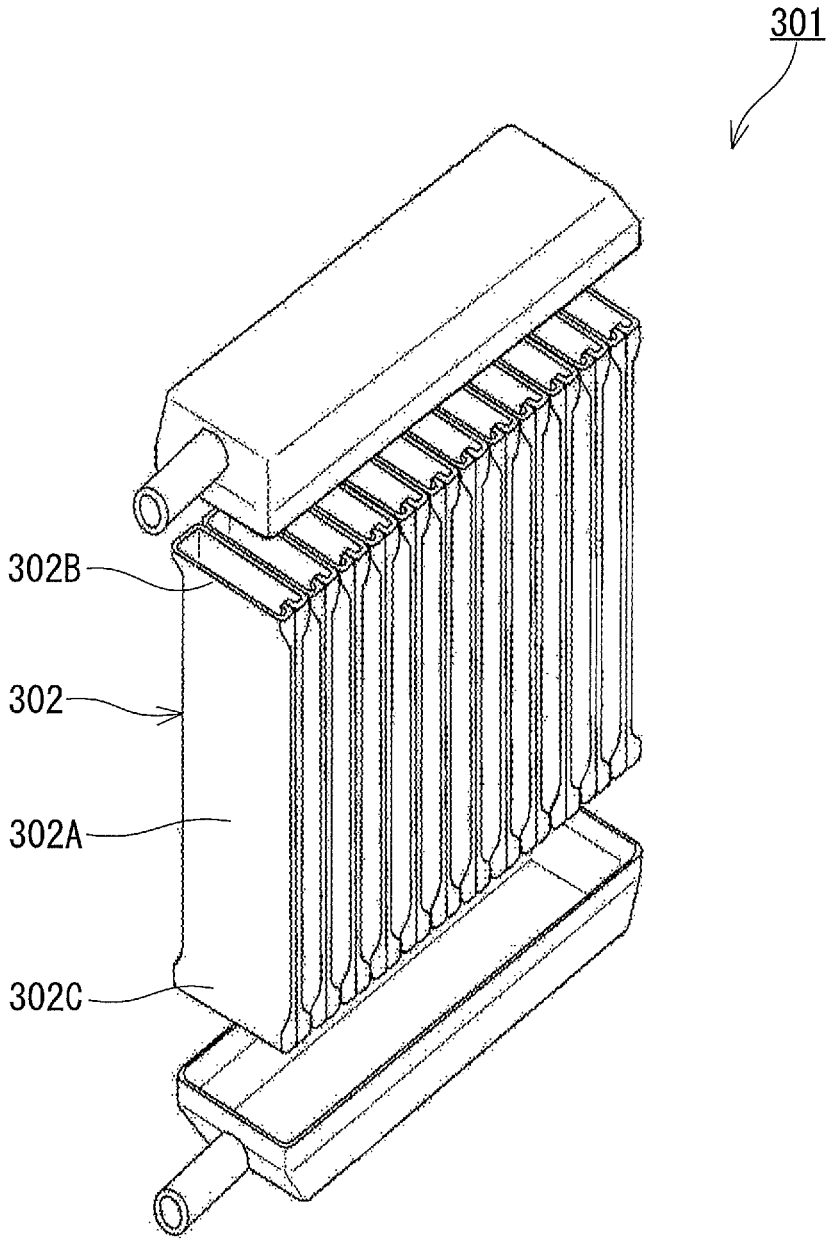
FIG. 12 is a perspective view of a conventional heat exchanger.
Figure 13:
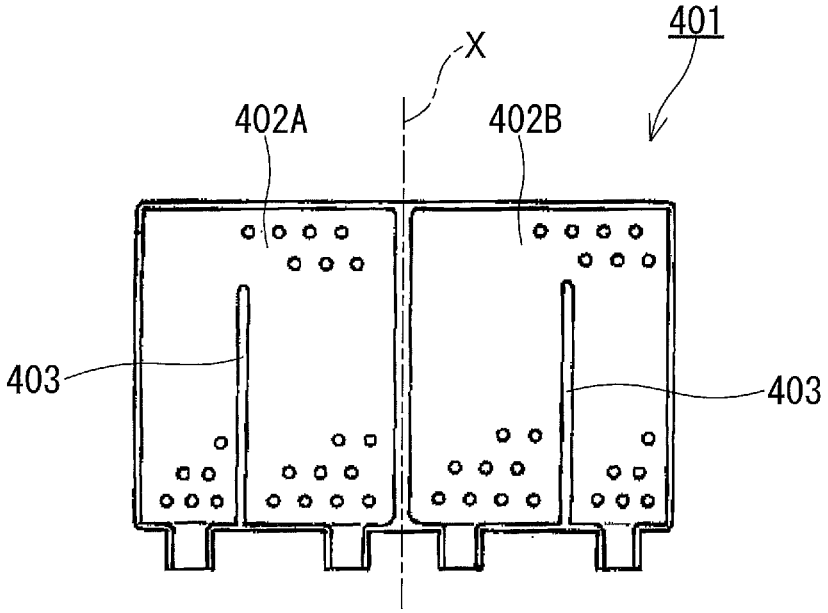
FIG. 13 is a plan view of a metal plate used for producing an element for a conventional laminated evaporator.
Figure 14:
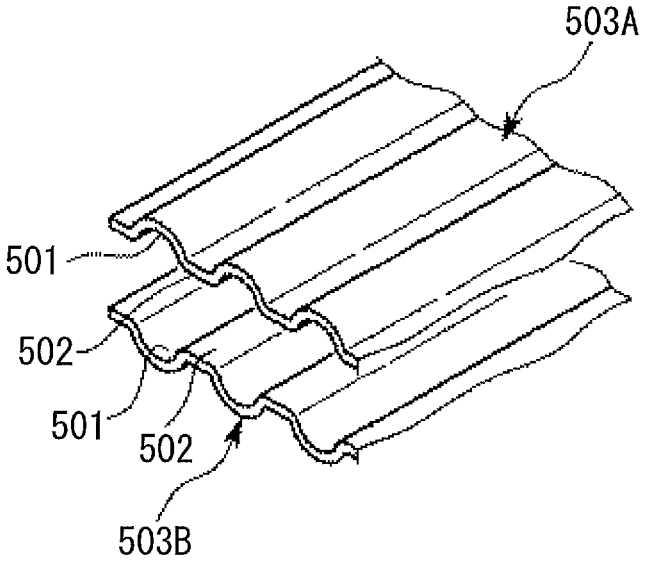
FIG. 14 is a perspective view of plate-shaped members used for producing a conventional heat exchange tube.
Figure 15:
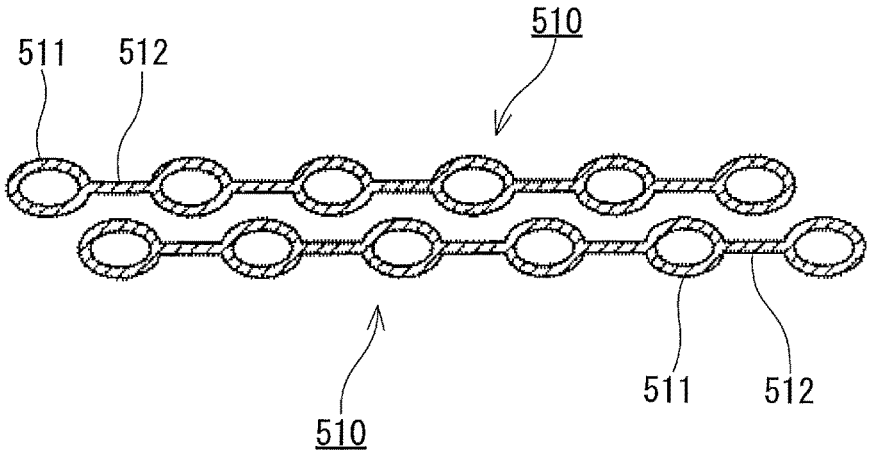
FIG. 15 is a cross-sectional view of a conventional heat exchange tube.

In the heat exchanger 301 shown in FIG. 12, edges of one plate member are bent toward the inside of the heat exchange tube 302. Because of this, the thickness of the heat exchange tube 302 is at least equal to the total thickness of four such plate members. Also, insertion of a jig into the heat exchange tube 302 or brazing is difficult. For these reasons, it is not easy to achieve size reduction and performance improvement of the heat exchanger 301 described in Patent Literature 1.

A first aspect of the present disclosure provides a heat exchanger including a plurality of heat exchange tubes each including an internal flow path in which a first fluid flows, an inlet of the internal flow path, and an outlet of the internal flow path, the heat exchange tubes being assembled so as to form an external flow path for a second fluid to be heat-exchanged with the first fluid, wherein the internal flow path includes a plurality of segments extending in a given row direction of the heat exchange tube, the heat exchange tube is constituted by a pair of plate members bonded together so as to form the internal flow path, the heat exchange tube further including: (i) a plurality of flow path forming portions projecting to both sides in a thickness direction of the heat exchange tube and respectively forming the segments of the internal flow path; (ii) a thin portion located between the flow path forming portions adjacent to each other in a width direction orthogonal to the row direction, the thin portion separating the segments of the internal flow path from each other along the row direction; (iii) a first projecting portion formed around the inlet of the internal flow path and projecting in the thickness direction of the heat exchange tube; and (iv) a second projecting portion formed around the outlet of the internal flow path and projecting in the thickness direction of the heat exchange tube, when two adjacent ones of the heat exchange tubes are defined as a first heat exchange tube and a second heat exchange tube, respectively, the first projecting portion of the first heat exchange tube is joined to a portion around the inlet of the second heat exchange tube, and the second projecting portion of the first heat exchange tube is joined to a portion around the outlet of the second heat exchange tube, in a cross-section perpendicular to the row direction, the flow path forming portion of the first heat exchange tube faces the thin portion of the second heat exchange tube across the external flow path, and the flow path forming portion of the second heat exchange tube faces the thin portion of the first heat exchange tube across the external flow path, and the flow path forming portions of the first heat exchange tube and the second heat exchange tube are arranged in a staggered pattern in the width direction.

According to the first aspect, the heat exchange tube is constituted by the pair of plate members bonded together so as to form the internal flow path. The thickness of such a heat exchange tube is at least equal to the total thickness of the two plate members. That is, according to the first aspect, reduction in thickness of the heat exchange tube can be achieved. This directly leads to a size reduction of the heat exchanger. In addition, since the heat exchange tube is produced by bonding the paired plate members together, use of a jig and brazing are relatively easy. Also, the first projecting portion and the second projecting portion of the first heat exchange tube are joined respectively to a portion around the inlet and a portion around the outlet of the second heat exchange tube. Therefore, according to the first aspect, the size of the heat exchanger can be reduced as compared with the case of providing a discrete hollow tube coupling the first heat exchange tube and the second heat exchange tube together. Also, the flow path forming portions of the first heat exchange tube and the second heat exchange tube are arranged in a staggered pattern in the width direction. Therefore, according to the first aspect, the increase and decrease in width of the external flow path which is formed between the first heat exchange tube and the second heat exchange tube and in which the second fluid flows can be reduced as compared with the case where the flow path forming portions are not arranged in a staggered pattern. In other words, the breadth of the external flow path in the thickness direction of the heat exchange tubes (the interval between the two adjacent heat exchange tubes) shows little variation in the width direction of the heat exchange tubes (the flow direction of the second fluid). Consequently, the pressure loss of the second fluid flowing in the external flow path can be reduced.

A second aspect provides the heat exchanger as set forth in the first aspect, wherein the heat exchange tube has a rectangular shape in plan view, and the heat exchange tube is provided with a pair of opening portions which are respectively formed as the inlet and the outlet at one end and the other end in a longitudinal direction of the heat exchange tube in such a manner as to penetrate through the heat exchange tube in the thickness direction. With such a configuration, the inner diameters of the inlet and the outlet can be increased, so the pressure loss of the first fluid at the inlet and the outlet can be reduced. Furthermore, the dimension (width) of the heat exchange tube in the width direction orthogonal to the longitudinal direction of the heat exchange tube can be reduced, so the size of the heat exchanger can be reduced.

A third aspect provides the heat exchanger as set forth in the first or second aspect, the heat exchange tubes have the same structure as each other, and assuming that the second heat exchange tube is rotated 180 degrees in a plane perpendicular to the thickness direction of the heat exchange tube so that the inlet of the second heat exchange tube communicates with the outlet of the first heat exchange tube and so that the outlet of the second heat exchange tube communicates with the inlet of the first heat exchange tube, then, in the width direction, positions of the flow path forming portions and the thin portion of the first heat exchange tube coincide with positions of the flow path forming portions and the thin portion of the second heat exchange tube. With such a configuration, the same metal mold can be used for production of both the first heat exchange tube and the second heat exchange tube, so the production cost of the heat exchange tubes can be reduced.

A fourth aspect provides the heat exchanger as set forth in any one of the first to third aspects, wherein the heat exchange tube further includes a plate-shaped portion provided at at least one selected from one end and the other end in the width direction, the plate-shaped portion projecting in a direction parallel to the width direction. With such a configuration, the plate-shaped portion functions as a heat transfer fin, so the heat exchange capacity of the heat exchanger is increased. Particularly, when the plate-shaped portion is formed to project in the flow direction of the second fluid, the separation of the second fluid at the end of the heat exchange tube can be suppressed by the plate-shaped portion, with the result that the heat exchange efficiency of the heat exchanger is improved.

When, in the heat exchanger, the heat exchange tubes are not provided with the plate-shaped portions, the interval between the adjacent heat exchange tubes is wide at the inlet and the outlet of the external flow path (the flow path of the second fluid), which reduces the likelihood of frost formation. Therefore, when the heat exchanger is intended solely for heat release from the first fluid to the second fluid, the heat exchange tubes are desirably provided with the plate-shaped portions. When the heat exchanger is supposed to be used for heat absorption by the first fluid from the second fluid, it is desirable not to provide the heat exchange tubes with the plate-shaped portions. Also, when the heat exchanger is used under given frost formation conditions, it is desirable that the plate-shaped portions be formed to project to such an extent as not to reach the inlet and the outlet of the external flow path (the outer periphery of the adjacent heat exchange tube, for example). In this case, the heat exchange efficiency of the heat exchanger is improved while frost formation at the inlet and the outlet of the external flow path is suppressed.

A fifth aspect provides the heat exchanger as set forth in any one of the first to fourth aspects, wherein, in the cross-section perpendicular to the row direction, a surface of the flow path forming portion extends from the thin portion in a direction inclined with respect to both the thickness direction and the width direction of the heat exchange tube. With such a configuration, the separation of the second fluid from the surface of the flow path forming portion can be suppressed when the second fluid is flowing in the external flow path. Consequently, the heat exchange efficiency of the heat exchanger is further improved.

A sixth aspect provides the heat exchanger as set forth in any one of the first to fifth aspects, wherein, in the cross-section perpendicular to the row direction, a surface of the flow path forming portion and a surface of the thin portion are connected to form a curved line. With such a configuration, the separation of the second fluid in the vicinity of the boundary between the flow path forming portion and the thin portion can be suppressed when the second fluid is flowing in the external flow path. Consequently, the heat exchange efficiency of the heat exchanger is further improved.

A seventh aspect provides the heat exchanger as set forth in any one of the first to sixth aspects, wherein, in the cross-section perpendicular to the row direction, (i) a profile of the flow path forming portion is formed by a curved line or (ii) a profile of the flow path forming portion is formed by a combination of a straight line and a curved line smoothly connected to the straight line. With such a configuration, the separation of the second fluid from a part or the whole of the surface of the flow path forming portion can be suppressed when the second fluid is flowing in the external flow path. Consequently, the heat exchange efficiency of the heat exchanger is further improved.

An eighth aspect provides the heat exchanger as set forth in any one of the first to seventh aspects, wherein, in the cross-section perpendicular to the row direction, the flow path forming portion includes a one-side portion and an opposite-side portion which are divided from each other by a junction plane between the paired plate members in the heat exchange tube, and the one-side portion and the opposite-side portion are symmetrical with respect to the junction plane. With such a configuration, the increase and decrease in width of the external flow path can be further reduced. Consequently, the pressure loss of the second fluid flowing outside the heat exchange tubes can be further reduced.

A ninth aspect provides the heat exchanger as set forth in any one of the first to eighth aspects, wherein the internal flow path is a serpentine flow path in which a flow direction of the first fluid is reversed between the inlet and the outlet, the plurality of segments includes a first segment and a second segment in which the first fluid flows in a direction opposite to a flow direction of the first fluid in the first segment, and the internal flow path further includes a curve segment connecting the first segment to the second segment. By providing the internal flow path of the heat exchange tube in the form of a serpentine flow path, temperature gradient is generated across the surface of the heat exchange tube in the region from the inlet to the outlet of the flow path of the second fluid (the external flow path). This permits the flows of the two fluids, which are basically orthogonal, to be quasi-counter to each other. Therefore, the temperature efficiency of the heat exchanger is improved, and the heat exchange efficiency of the heat exchanger is improved.

A tenth aspect provides the heat exchanger as set forth in the ninth aspect, wherein the heat exchange tube further includes an inhibitory structure that is provided in the thin portion and that inhibits heat transfer between the first fluid flowing in the first segment and the first fluid flowing in the second segment. With such a configuration, the temperature difference between the first segment and the second segment is maintained. Therefore, the temperature efficiency of the heat exchanger is further improved, and the heat exchange efficiency of the heat exchanger is improved.

An eleventh aspect provides the heat exchanger as set forth in any one of the first to tenth aspects, further including: an inlet header joined to the first projecting portion of the heat exchange tube that forms an end face of the heat exchanger, the inlet header being adapted to feed the first fluid to the inlet of the internal flow path; and an outlet header joined to the second projecting portion of the heat exchange tube forming the end face of the heat exchanger, the outlet header being adapted to discharge the first fluid through the outlet of the internal flow path. With such a configuration, the size of the heat exchanger can be reduced as compared with the case of providing a discrete hollow tube including the inlet header and the outlet header.

A twelfth aspect provides the heat exchanger as set forth in the ninth aspect, wherein the internal flow path further includes a most upstream segment in which the first fluid flows, the most upstream segment being formed upstream of the first segment around the inlet, and the heat exchange tube further includes: (i) a most upstream thin portion dividing the curve segment from the most upstream segment; and (ii) an upstream inhibitory structure that is provided in the most upstream thin portion and that inhibits heat transfer between the first fluid flowing in the curve segment and the first fluid flowing in the most upstream segment. With such a configuration, it is possible to inhibit heat transfer between the first fluid flowing in the curve segment and the first fluid flowing in the most upstream segment between which there is a large temperature difference.

A thirteenth aspect provides the heat exchanger as set forth in the twelfth aspect, wherein the upstream inhibitory structure is formed in a region of the most upstream thin portion that is closest to the inlet. There is a large temperature difference between the first fluid that has just flowed into the internal flow path and the first fluid flowing in the curve segment. Therefore, with the upstream inhibitory structure provided in the region closest to the inlet, heat transfer between the first fluid flowing in the curve segment and the first fluid flowing in the most upstream segment can be effectively inhibited.

A fourteenth aspect provides the heat exchanger as set forth in the twelfth or thirteenth aspect, wherein the upstream inhibitory structure is a through hole penetrating through the most upstream thin portion in a thickness direction of the paired plate members. When the upstream inhibitory structure is a through hole, the most upstream segment and the curve segment in the internal flow path are separated by a space. Consequently, heat transfer between the first fluid flowing in the most upstream segment and the first fluid flowing in the curve segment is reliably inhibited.

A fifteenth aspect provides the heat exchanger as set forth in the ninth aspect, wherein the internal flow path further includes a most downstream segment in which the first fluid flows, the most downstream segment being formed downstream of the second segment around the outlet, and the heat exchange tube further includes: (i) a most downstream thin portion dividing the curve segment from the most downstream segment; and (ii) a downstream inhibitory structure that is provided in the most downstream thin portion and that inhibits heat transfer between the first fluid flowing in the curve segment and the first fluid flowing in the most downstream segment. With such a configuration, it is possible to inhibit heat transfer between the first fluid flowing in the curve segment and the first fluid flowing in the most downstream segment between which there is a large temperature difference.

A sixteenth aspect provides the heat exchanger as set forth in the fifteenth aspect, wherein the downstream inhibitory structure is formed in a region of the most downstream thin portion that is closest to the outlet. There is a large temperature difference between the first fluid flowing in the curve segment and the first fluid flowing in the most downstream segment. Therefore, with the downstream inhibitory structure provided in the region closest to the outlet, heat transfer between the first fluid flowing in the curve segment and the first fluid flowing in the most downstream segment can be effectively inhibited.

A seventeenth aspect provides the heat exchanger as set forth in the fifteenth or sixteenth aspect, wherein the downstream inhibitory structure is a through hole penetrating through the most downstream thin portion in a thickness direction of the paired plate members. When the downstream inhibitory structure is a through hole, the most downstream segment and the curve segment in the internal flow path are separated by a space. Consequently, heat transfer between the first fluid flowing in the most downstream segment and the first fluid flowing in the curve segment is reliably inhibited.

Hereinafter, embodiments of the present invention will be described with reference to the drawings. It should be noted that the present invention is not limited by the embodiments described below.

First Embodiment

Figure 1:
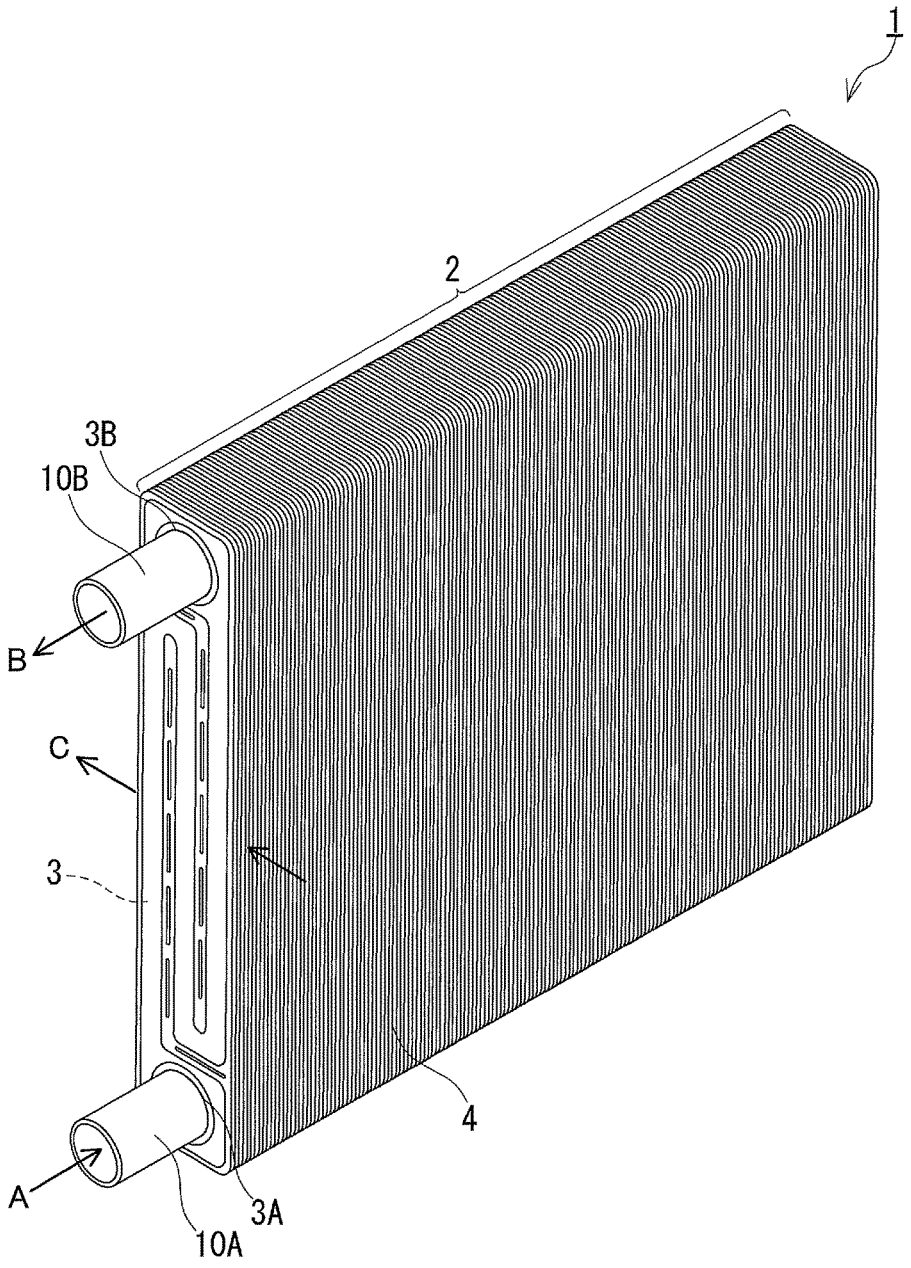
FIG. 1 is a perspective view of a heat exchanger according to a first embodiment of the present invention.

As shown in FIG. 1, a heat exchanger 1 according to a first embodiment of the present invention includes a plurality of heat exchange tubes 2, an inlet header 10A, and an outlet header 10B. The heat exchange tubes 2 each have a rectangular shape in plan view, and are arranged at predetermined intervals. A first fluid (e.g., a refrigerant) flows inside the heat exchange tubes 2. The heat exchange tubes 2 are assembled so that a flow path of a second fluid (e.g., outside air) to be heat-exchanged with the first fluid is formed outside the heat exchange tubes 2. Specifically, the flow path of the second fluid is formed between the heat exchange tubes 2 adjacent to each other. The inlet header 10A and the outlet header 10B are each attached to the heat exchange tube 2 that forms one end face (left end face in FIG. 1) of the heat exchanger 1 in the direction in which the heat exchange tubes 2 are arranged. With such a configuration, the size of the heat exchanger 1 can be reduced as compared with the case of providing a discrete hollow tube including the inlet header 10A and the outlet header 10B.

Figure 2A:
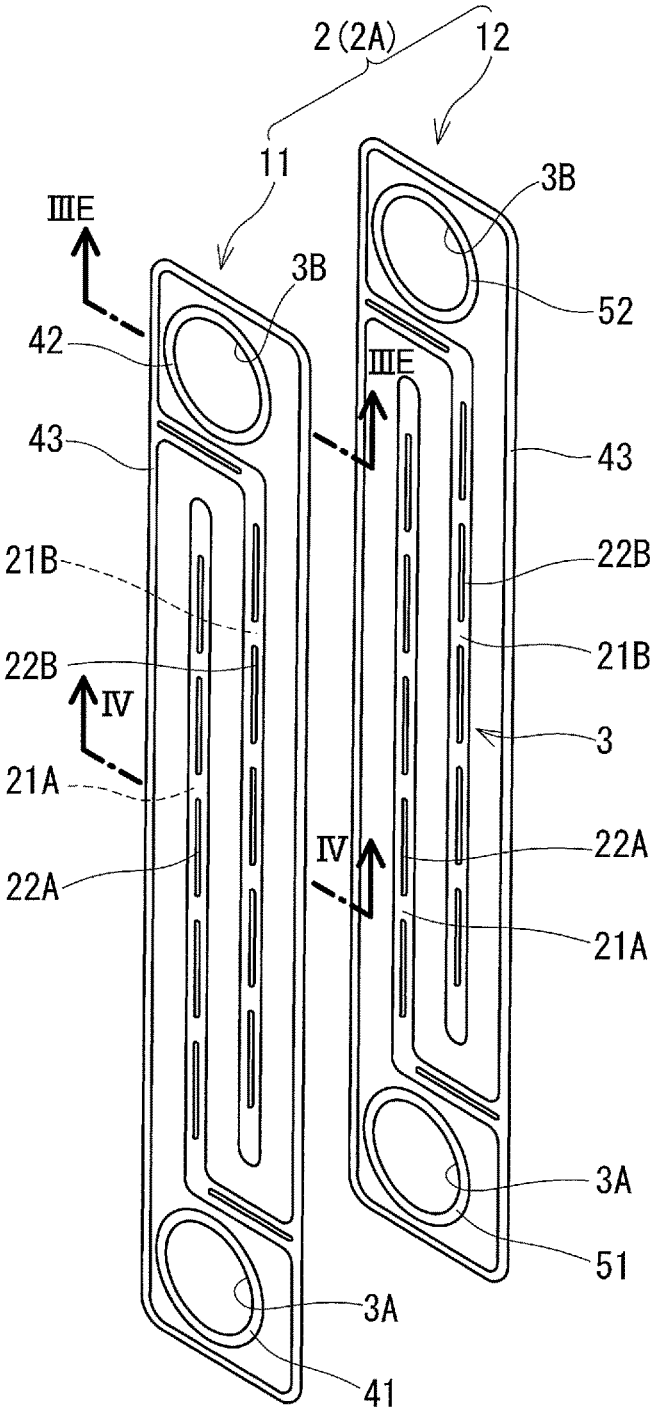
FIG. 2A is an exploded perspective view of a first heat exchange tube of the heat exchanger of FIG. 1.

As shown in FIG. 2A, the heat exchange tube 2 has an internal flow path 3 in which the first fluid flows. The inlet header 10A is a tube for feeding the first fluid to an inlet 3A of the internal flow path 3. The outlet header 10B is a tube for discharging the first fluid through an outlet 3B of the internal flow path 3. The inlet header 10A is connected to an external device (not shown) that feeds the first fluid. The outlet header 10B is connected to an external device (not shown) that recovers the first fluid.

As indicated by an arrow A in FIG. 1, the first fluid discharged from the external device is fed to the internal flow paths 3 of the heat exchange tubes 2 through the inlet header 10A. As indicated by an arrow B in FIG. 1, the first fluid having exchanged heat with the second fluid by passing through the internal flow paths 3 is discharged through the outlet header 10B to the external device that recovers the first fluid. As indicated by an arrow C in FIG. 1, the second fluid flows through gaps (external flow path 4) between the adjacent heat exchange tubes 2 in a direction parallel to the width direction of the heat exchange tubes 2. The width direction of the heat exchange tubes 2 corresponds to a direction perpendicular both to the longitudinal direction of the heat exchange tubes 2 and to the direction in which the heat exchange tubes 2 are arranged. The upstream portion of the internal flow path 3 is located relatively downstream in the flow direction of the second fluid, while the downstream portion of the internal flow path 3 is located relatively upstream in the flow direction of the second fluid. That is, the flow direction of the second fluid is quasi-counter to the flow direction of the first fluid.

As shown in FIG. 2A, the heat exchange tube 2 is constituted by a first plate member 11 and a second plate member 12 bonded together so as to form the internal flow path 3. The internal flow path 3 is a serpentine flow path in which the flow direction of the first fluid is reversed between the inlet 3A and the outlet 3B. In the present embodiment, the flow direction of the first fluid is reversed a plurality of times (twice). The heat exchange tube 2 has a rectangular shape in plan view. The opening portion serving as the inlet 3A is formed at one end (lower end in FIG. 2A) in the longitudinal direction of the heat exchange tube 2 in such a manner as to penetrate through the heat exchange tube 2 in its thickness direction. The opening portion serving as the outlet 3B is formed at the other end (upper end in FIG. 2A) in the longitudinal direction of the heat exchange tube 2 in such a manner as to penetrate through the heat exchange tube 2 in its thickness direction. The internal flow path 3 has an odd number of sections extending in a row direction parallel to the longitudinal direction (three sections in the present embodiment, a first segment 31, a second segment 32, and a third segment 33 which will be described later). In the present embodiment, the internal flow path 3 includes three sections parallel to each other (the first segment 31, the second segment 32, and the third segment 33). With such a configuration, the inner diameters of the inlet header 10A and the outlet header 10B can be increased, so the pressure loss inside the inlet header 10A and the outlet header 10B can be reduced. Furthermore, the dimension in the width direction of the heat exchange tube 2 can be reduced, so the size of the heat exchanger 1 can be reduced.

Figure 3A:
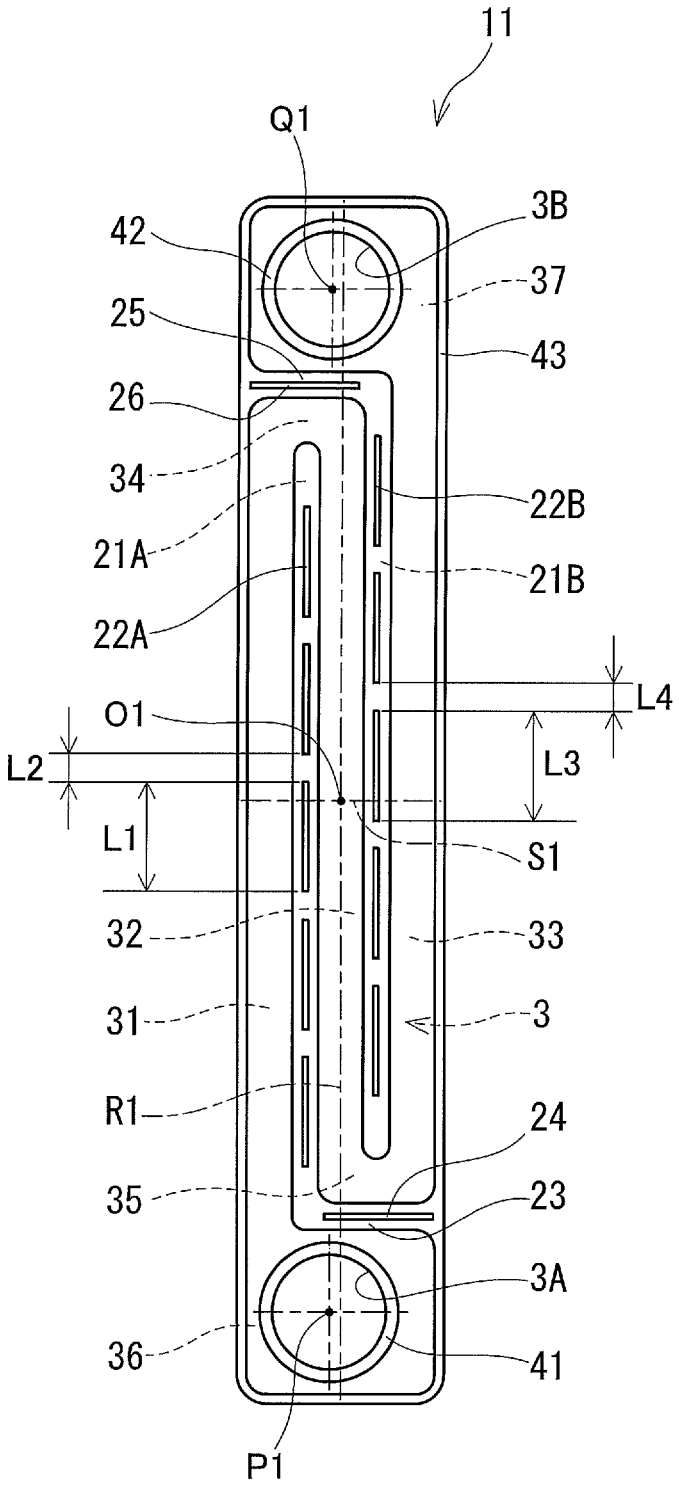
FIG. 3A is a plan view of the first plate member of the first heat exchange tube of FIG. 2A.
Figure 3B:
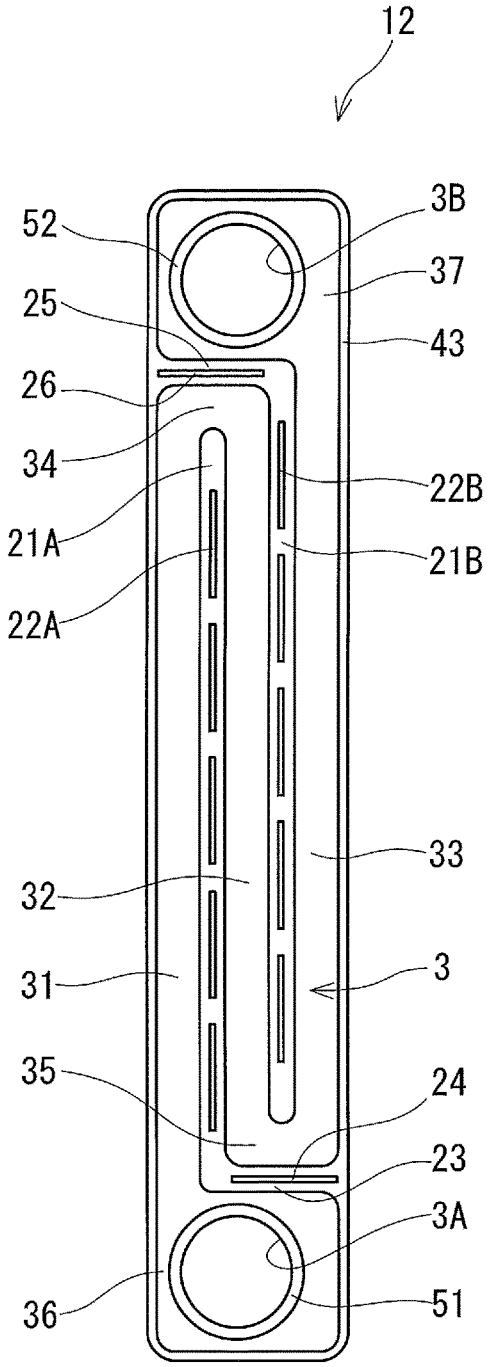
FIG. 3B is a plan view of the second plate member of the first heat exchange tube of FIG. 2A.

As shown in FIG. 3A and FIG. 3B, the internal flow path 3 has the first segment 31, the second segment 32, the third segment 33, a first curve segment 34, a second curve segment 35, a most upstream segment 36, and a most downstream segment 37. FIG. 3A shows the first plate member 11 when the first plate member 11 and the second plate member 12 are bonded together, while FIG. 3B shows the second plate member 12 when the first plate member 11 and the second plate member 12 are bonded together. The internal flow path 3 is a space formed when the first plate member 11 and the second plate member 12 are bonded together. The first segment 31 extends from the inlet 3A in the longitudinal direction of the heat exchange tube 2. The second segment 32 extends in such a manner that the first fluid flows in a direction (the downward direction in FIG. 3A and FIG. 3B) opposite to the flow direction of the first fluid in the first segment 31 (the upward direction in FIG. 3A and FIG. 3B). The third segment 33 extends in such a manner that the first fluid flows in a direction (the upward direction in FIG. 3A and FIG. 3B) opposite to the flow direction of the first fluid in the second segment 32 (the downward direction in FIG. 3A and FIG. 3B). The first curve segment 34 connects the first segment 31 to the second segment 32. The second curve segment 35 connects the second segment 32 to the third segment 33. The most upstream segment 36 is a section in which the first fluid flows and which is formed upstream of the first segment 31 around the inlet 3A. The most downstream segment 37 is a section in which the first fluid flows and which is formed downstream of the third segment 33 around the outlet 3B. The first fluid fed through the inlet header 10A meanders sequentially through the inlet 3A, the most upstream segment 36, the first segment 31, the first curve segment 34, the second segment 32, the second curve segment 35, the third segment 33, the most downstream segment 37, and the outlet 3B, and is discharged through the outlet header 10B.

As shown in FIG. 3A and FIG. 3B, the heat exchange tube 2 has a first thin portion 21A dividing the first segment 31 from the second segment 32 and a second thin portion 21B dividing the second segment 32 from the third segment 33. In the first thin portion 21A, through holes 22A are formed. In the second thin portion 21B, second through holes 22B are formed. The first thin portion 21A and the second thin portion 21B are junction portions between the first plate member 11 and the second plate member 12. The first through hole 22A functions as an inhibitory structure that inhibits heat transfer between the first fluid flowing in the first segment 31 and the first fluid flowing in the second segment 32. The second through hole 22B functions as an inhibitory structure that inhibits heat transfer between the first fluid flowing in the second segment 32 and the first fluid flowing in the third segment 33. With such a configuration, the size of the heat exchanger 1 can be reduced, and the heat exchange efficiency of the heat exchanger 1 can be improved, as compared with those of conventional heat exchangers. When the inhibitory structures are the through holes 22A and 22B, the adjacent segments of the internal flow path 3 are separated from each other by spaces. Therefore, heat transfer as mentioned above is reliably inhibited.

In the present embodiment, the first through hole 22A is a through hole (particularly, a slit) penetrating through the first thin portion 21A in the thickness direction of the first plate member 11 and the second plate member 12. The first through hole 22A is formed in the widthwise center of the first thin portion 21A, and has a rectangular shape in plan view. The second through hole 22B is a through hole (particularly, a slit) penetrating through the second thin portion 21B in the thickness direction of the first plate member 11 and the second plate member 12. The second through hole 22B is formed in the widthwise center of the second thin portion 21B, and has a rectangular shape in plan view. The first through holes 22A are arranged at predetermined intervals in the longitudinal direction of the first thin portion 21A. The second through holes 22B are arranged at predetermined intervals in the longitudinal direction of the second thin portion 21B.

In a cross-section parallel to a direction orthogonal to the thickness direction of the first plate member 11 and the second plate member 12, the total cross-sectional area (the sum of the cross-sectional areas) of the first through holes 22A is smaller than ½ of the cross-sectional area of the first thin portion 21A. For example, the sum of the cross-sectional areas of the first through holes 22A is 20% to 50% of the cross-sectional area of the first thin portion 21A. As shown in FIG. 3A, the length L1 of the first through hole 22A in the longitudinal direction is greater than the length of the interval L2 between the two adjacent first through holes 22A. For example, the length L1 of the first through hole 22A in the longitudinal direction is two to ten times the length of the interval L2 between the two adjacent first through holes 22A. In a cross-section orthogonal to the thickness direction of the first plate member 11 and the second plate member 12, the total cross-sectional area of the second through holes 22B is smaller than ½ of the cross-sectional area of the second thin portion 21B. For example, the sum of the cross-sectional areas of the second through holes 22B is 20% to 50% of the cross-sectional area of the second thin portion 21B. As shown in FIG. 3A, the length L3 of the second through hole 22B in the longitudinal direction is greater than the length of the interval L4 between the two adjacent second through holes 22B. For example, the length L3 of the second through hole 22B in the longitudinal direction is two to ten times the length of the interval L4 between the two adjacent second through holes 22B. The length L3 of the second through hole 22B in the longitudinal direction is equal to the length L1 of the first through hole 22A in the longitudinal direction. The length of the interval L4 between the two adjacent second through holes 22B is equal to the length of the interval L2 between the two adjacent first through holes 22A. With such a configuration, heat transfer between the first fluid flowing in the first segment 31 and the first fluid flowing in the second segment 32 can be effectively and reliably inhibited. Heat transfer between the first fluid flowing in the second segment 32 and the first fluid flowing in the third segment 33 can also be effectively and reliably inhibited. Additionally, the strength of the heat exchange tube 2 is maintained.

The shape, arrangement, number, cross-sectional area, etc., of the first through holes 22A and the second through holes 22B are not particularly limited. For example, the first through hole 22A may have another shape, such as a circular, polygonal, or elliptical shape, in plan view. In the first thin portion 21A there may be formed only one first through hole 22A. However, when, as in the present embodiment, two or more first through holes 22A are formed at predetermined intervals in the first thin portion 21A, it is possible to effectively inhibit heat transfer between the first fluid flowing in the first segment 31 and the first fluid flowing in the second segment 32 while preventing reduction in strength of the first thin portion 21A. Additionally, warpage of the plate members 11 and 12 in processing the plate members 11 and 12 can be reduced. These also apply to the second through holes 22B.

As shown in FIG. 2A, FIG. 3A, and FIG. 3B, the heat exchange tube 2 further has: a most upstream thin portion 23 dividing the second curve segment 35 from the most upstream segment 36; and a third through hole 24 provided in the most upstream thin portion 23. The most upstream thin portion 23 is a thin portion formed when the first plate member 11 and the second plate member 12 are bonded together. The third through hole 24 functions as an upstream inhibitory structure that inhibits heat transfer between the first fluid flowing in the second curve segment 35 and the first fluid flowing in the most upstream segment 36. The third through hole 24 is formed in a region of the most upstream thin portion 23 that is closest to the inlet 3A. The third through hole 24 is a through hole (particularly, a slit) penetrating through the most upstream thin portion 23 in the thickness direction of the first plate member 11 and the second plate member 12. The third through hole 24 is formed in a central region of the most upstream thin portion 23, and has a rectangular shape in plan view. With such a configuration, heat transfer between the first fluid flowing in the second curve segment 35 and the first fluid flowing in the most upstream segment 36 can be effectively and reliably inhibited.

As shown in FIG. 2A, FIG. 3A, and FIG. 3B, the heat exchange tube 2 further has: a most downstream thin portion 25 dividing the first curve segment 34 from the most downstream segment 37; and a fourth through hole 26 provided in the most downstream thin portion 25. The most downstream thin portion 25 is a thin portion formed when the first plate member 11 and the second plate member 12 are bonded together. The fourth through hole 26 functions as a downstream inhibitory structure that inhibits heat transfer between the first fluid flowing in the first curve segment 34 and the first fluid flowing in the most downstream segment 37. The fourth through hole 26 is formed in a region of the most downstream thin portion 25 that is closest to the outlet 3B. The fourth through hole 26 is a through hole (particularly, a slit) penetrating through the most downstream thin portion 25 in the thickness direction of the first plate member 11 and the second plate member 12. The fourth through hole 26 is formed in a central region of the most downstream thin portion 25, and has a rectangular shape in plan view. With such a configuration, heat transfer between the first fluid flowing in the first curve segment 34 and the first fluid flowing in the most downstream segment 37 can be effectively and reliably inhibited. As with the first through holes 22A, the shape, arrangement, number, cross-sectional area, etc., of the third through hole 24 and the fourth through hole 26 are not particularly limited.

As shown in FIG. 2A, FIG. 3A, FIG. 3B, and FIG. 3E, the heat exchange tube 2 further has a first projecting portion 41, a second projecting portion 42, a third projecting portion 51, a fourth projecting portion 52, and an outer peripheral portion 43. The first projecting portion 41 is formed around the inlet 3A of the first plate member 11, and projects to one side in the thickness direction (to the left in FIG. 2A). The second projecting portion 42 is formed around the outlet 3B of the first plate member 11, and projects to one side in the thickness direction of the first plate member 11 (to the left in FIG. 2A). The third projecting portion 51 is formed around the inlet 3A of the second plate member 12, and projects to one side in the thickness direction of the second plate member 12 (to the right in FIG. 2A). The fourth projecting portion 52 is formed around the outlet 3B of the second plate member 12, and projects to one side in the thickness direction of the second plate member 12 (to the right in FIG. 2A). The outer peripheral portion 43 is formed by the outer peripheral portion of the first plate member 11 and the outer peripheral portion of the second plate member 12. The outer peripheral portion of the first plate member 11 projects to the other side in the thickness direction of the first plate member 11 (to the right in FIG. 2A). The outer peripheral portion of the second plate member 12 projects to the other side in the thickness direction of the second plate member 12 (to the left in FIG. 2A). The first projecting portion 41, the second projecting portion 42, the third projecting portion 51, and the fourth projecting portion 52 each have an annular shape in plan view. The outer peripheral portion 43 has a frame shape in plan view.

As shown in FIG. 2A, FIG. 3A, and FIG. 3B, the outer peripheral portion 43 functions as a brazing portion when the first plate member 11 and the second plate member 12 are brazed together. The outer peripheral portion 43 is continuous with the most upstream thin portion 23 and the most downstream thin portion 25. The most upstream thin portion 23 and the most downstream thin portion 25 also function as brazing portions. The most upstream thin portion 23 and the most downstream thin portion 25 are continuous with the first thin portion 21A and the second thin portion 21B, respectively. The first thin portion 21A and the second thin portion 21B also function as brazing portions.

In the present embodiment, the first through holes 22A are formed in the first thin portion 21A. When the heat exchange tube 2 is viewed in plan, the first thin portion 21A as a brazing portion is present around the first through holes 22A. The other thin portions and through holes have the same configuration. In a cross-section parallel to the direction orthogonal to the thickness direction of the first plate member 11 and the second plate member 12, the minimum widths of the brazing portions are greater than the thicknesses of the first plate member 11 and the second plate member 12. That is, when the heat exchange tube 2 is viewed in plan, the respective minimum widths of the first thin portion 21A, the second thin portion 21B, the most upstream thin portion 23, the most downstream thin portion 25, and the outer peripheral portion 43 are greater than the respective thicknesses of the first plate member 11 and the second plate member 12. Such a configuration ensures that the first thin portion 21A, the second thin portion 21B, the most upstream thin portion 23, the most downstream thin portion 25, and the outer peripheral portion 43, which function as the brazing portions, have a sufficient area; therefore, the first plate member 11 and the second plate member 12 can be firmly joined.

For production of the heat exchange tube 2, clad materials consisting of an aluminum alloy plate or a stainless steel alloy plate having both surfaces coated with a brazing material such as silver solder are prepared as the first plate member 11 and the second plate member 12. Next, portions corresponding to the outer peripheral portion 43, the first thin portion 21A, the second thin portion 21B, the most upstream thin portion 23, and the most downstream thin portion 25 are formed in both the first plate member 11 and the second plate member 12 by rolling process or pressing process. Holes for forming the first through holes 22A, the second through holes 22B, the third through hole 24, and the fourth through hole 26 are formed in the first plate member 11 and the second plate member 12 simultaneously. Next, the first plate member 11 and the second plate member 12 are placed on each other, and pressure and heat are applied between the first plate member 11 and the second plate member 12 so that the first thin portion 21A, the second thin portion 21B, the most upstream thin portion 23, the most downstream thin portion 25, and the outer peripheral portion 43 are formed. By thus brazing the first plate member 11 and the second plate member 12 together, the heat exchange tube 2 is obtained. Alternatively, the first through holes 22A, the second through holes 22B, the third through hole 24, and the fourth through hole 26 may be respectively formed in the first thin portion 21A, the second thin portion 21B, the most upstream thin portion 23, and the most downstream thin portion 25 by performing cutting process after brazing of the first plate member 11 and the second plate member 12.

Figure 2B:
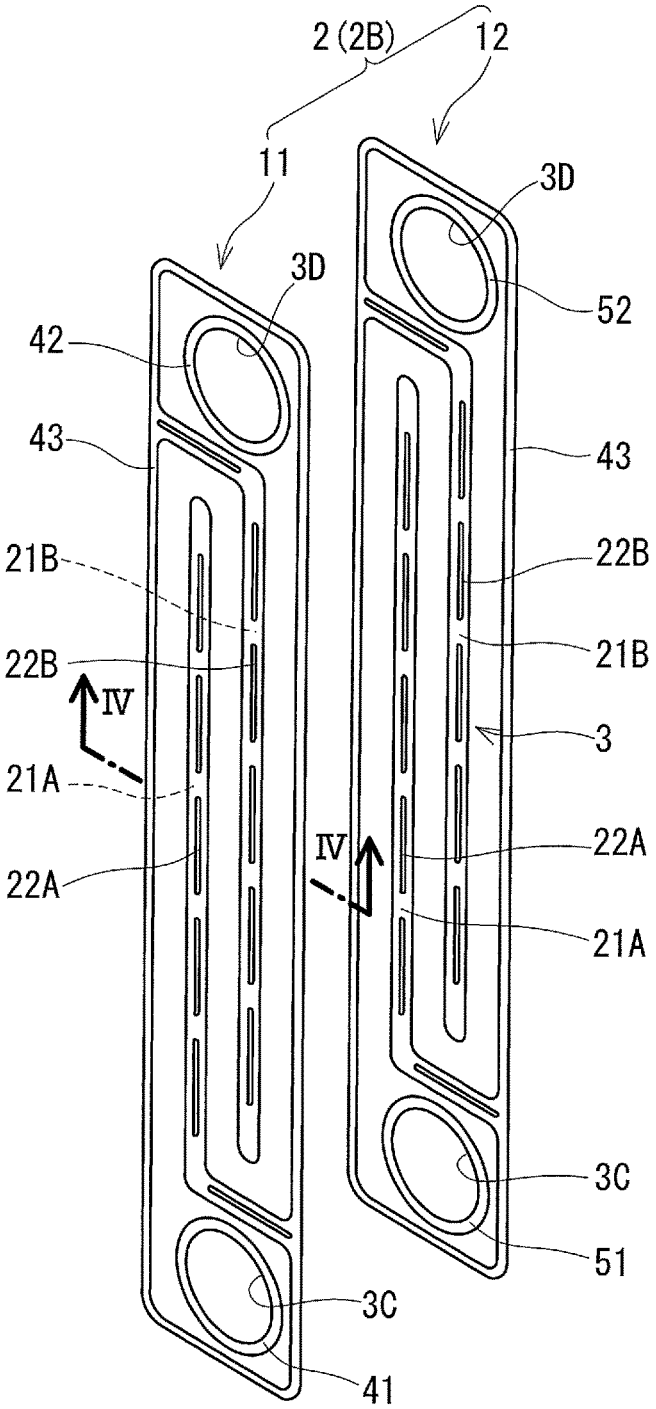
FIG. 2B is an exploded perspective view of a second heat exchange tube of the heat exchanger of FIG. 1.
Figure 2C:
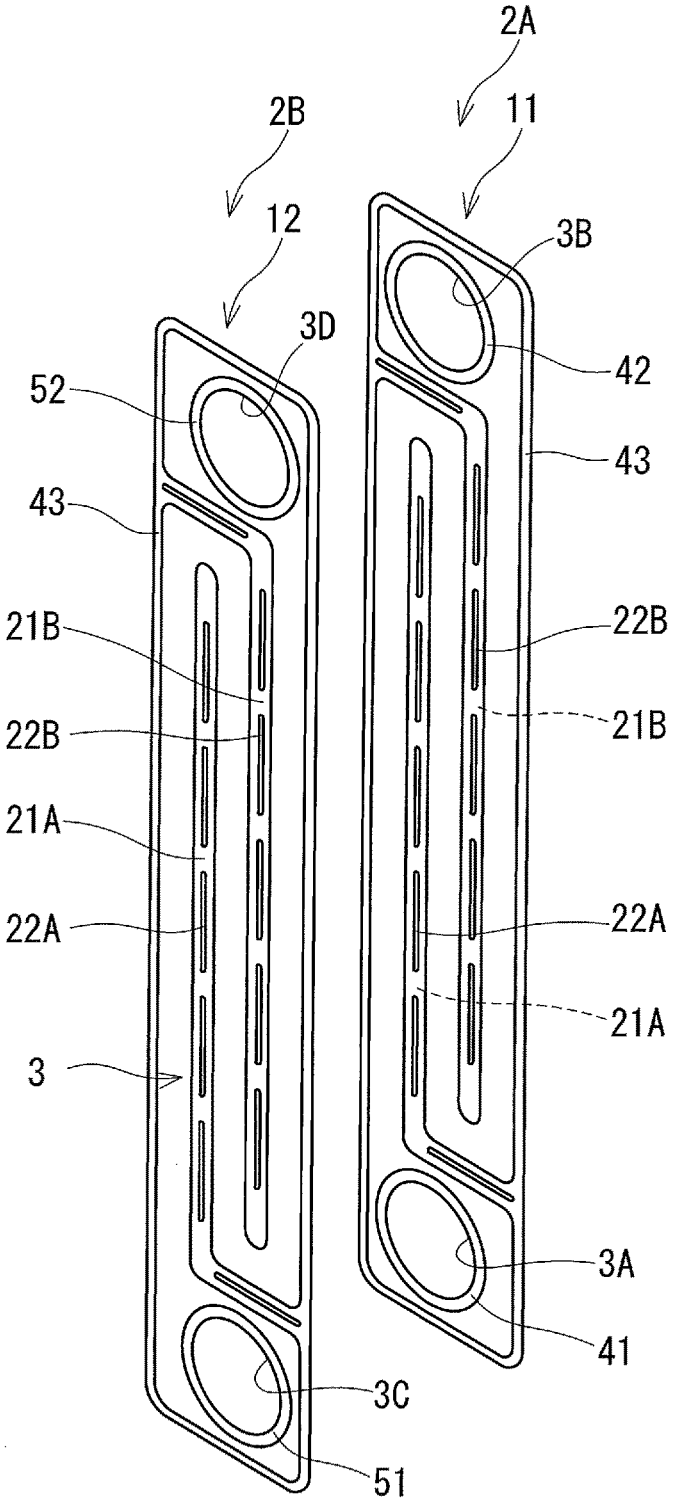
FIG. 2C is a perspective view of a first plate member of the first heat exchange tube and a second plate member of the second heat exchange tube which are included in the heat exchanger of FIG. 1.
Figure 5:
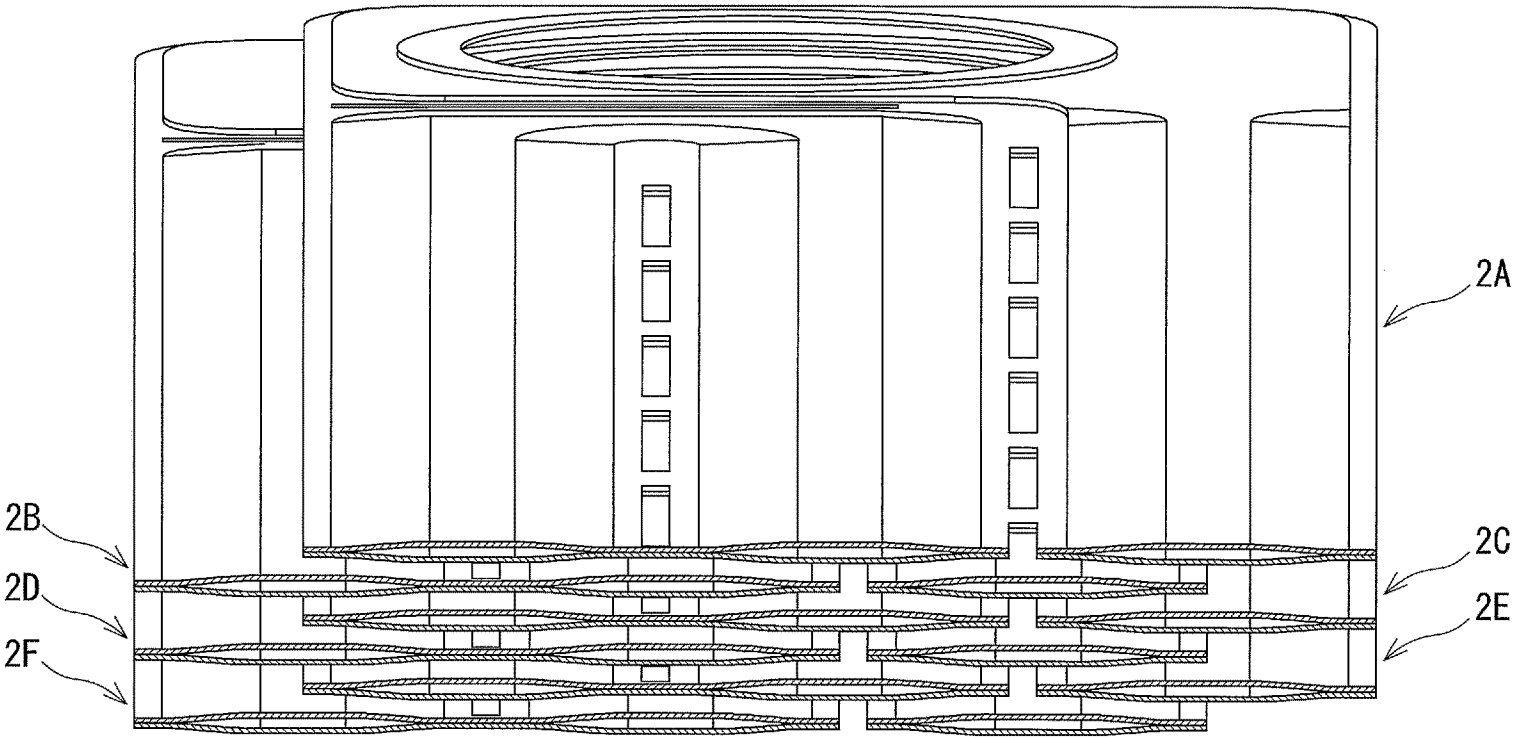
FIG. 5 is a partially cut-away perspective view of the heat exchange tube of FIG. 1.
Figure 6:
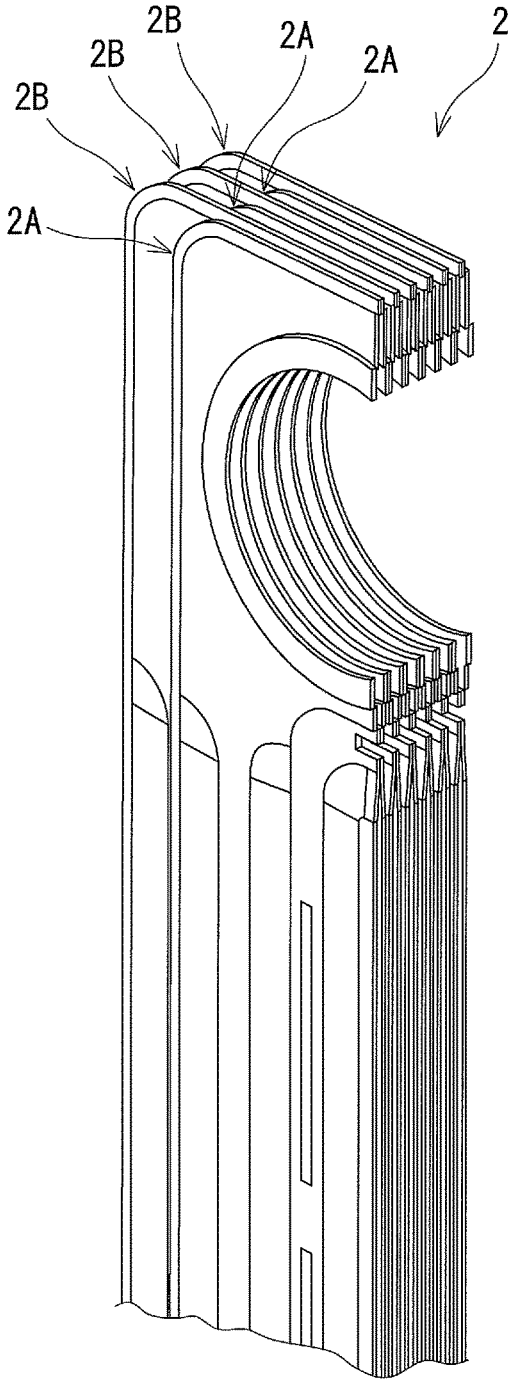
FIG. 6 is another partially cut-away perspective view of the heat exchange tube of FIG. 1.
Figure 7A:
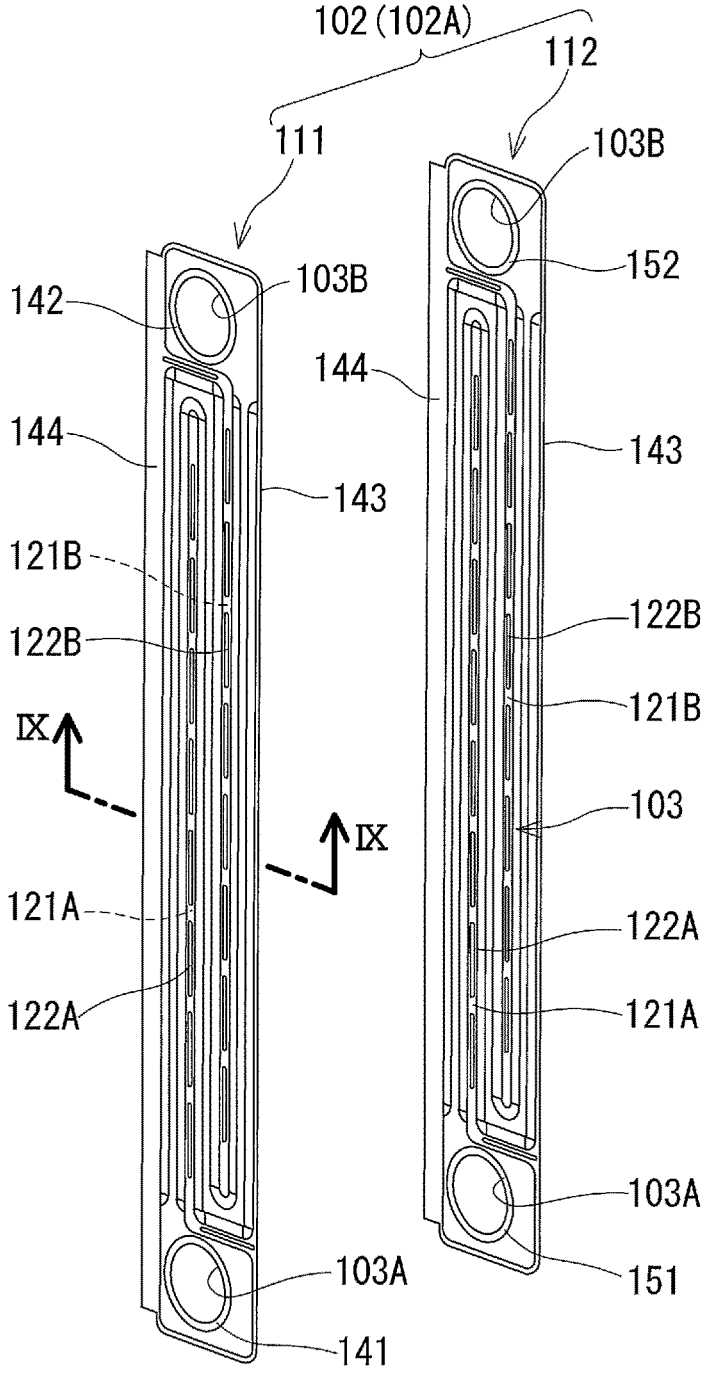
FIG. 7A is an exploded perspective view of a first heat exchange tube of a heat exchanger according to a second embodiment of the present invention.
Figure 7B:
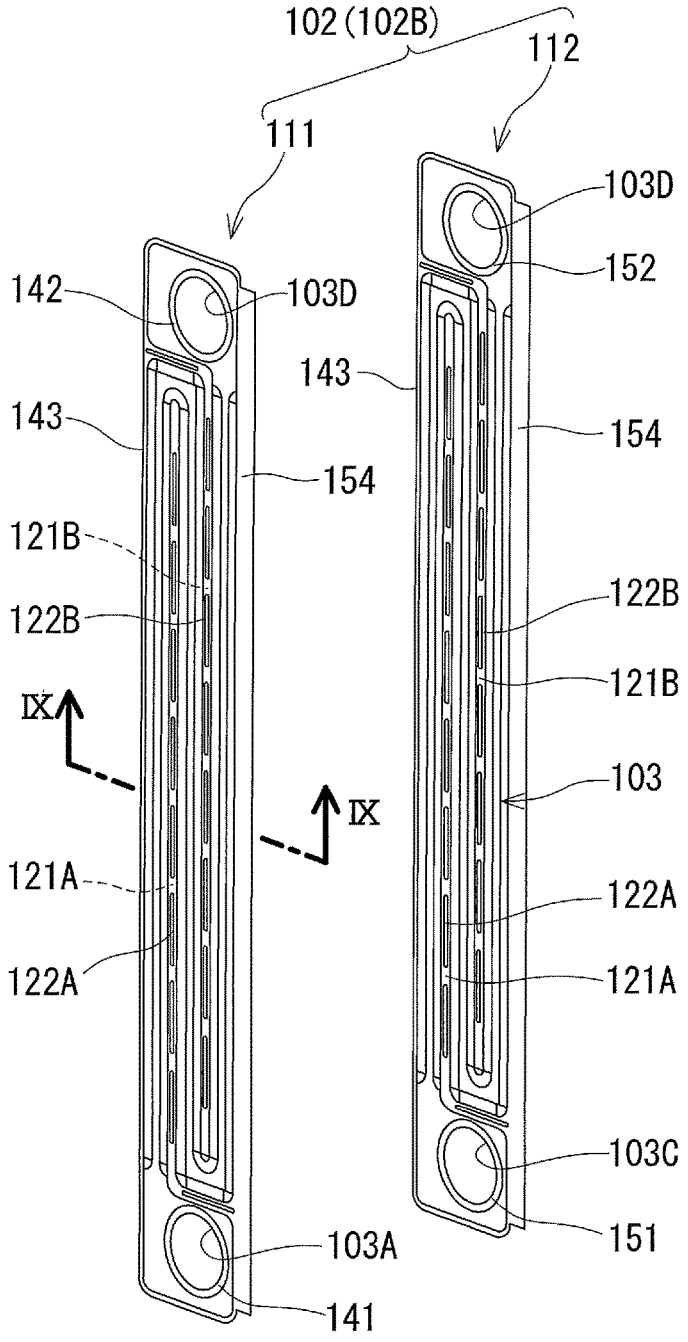
FIG. 7B is an exploded perspective view of a second heat exchange tube of the heat exchanger according to the second embodiment of the present invention.
Figure 7C:
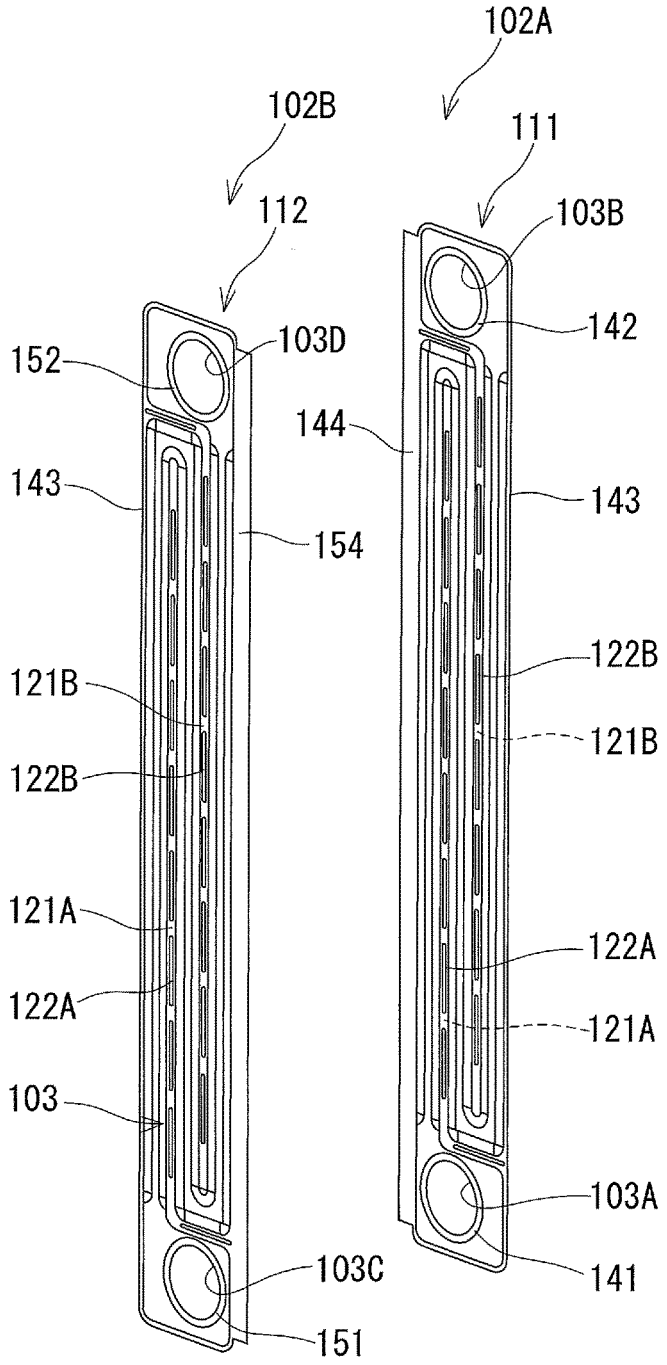
FIG. 7C is a perspective view of a first plate member of the first heat exchange tube and a second plate member of the second heat exchange tube which are included in the heat exchanger according to the second embodiment of the present invention.
Figure 8A:
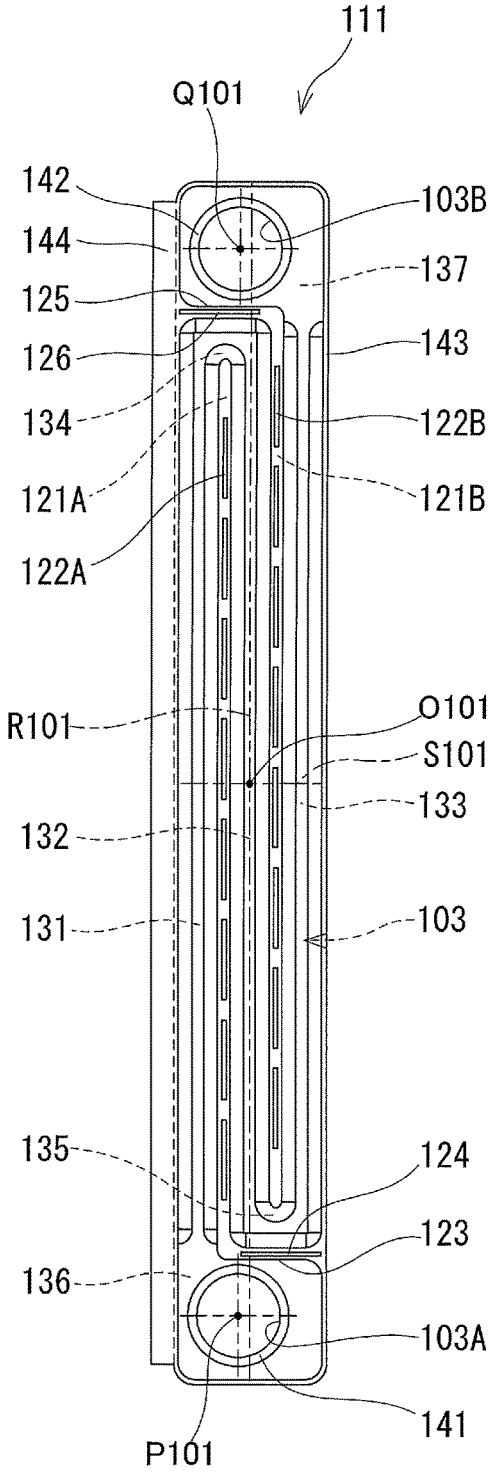
FIG. 8A is a plan view of the first plate member of the first heat exchange tube of FIG. 7A.
Figure 8B:
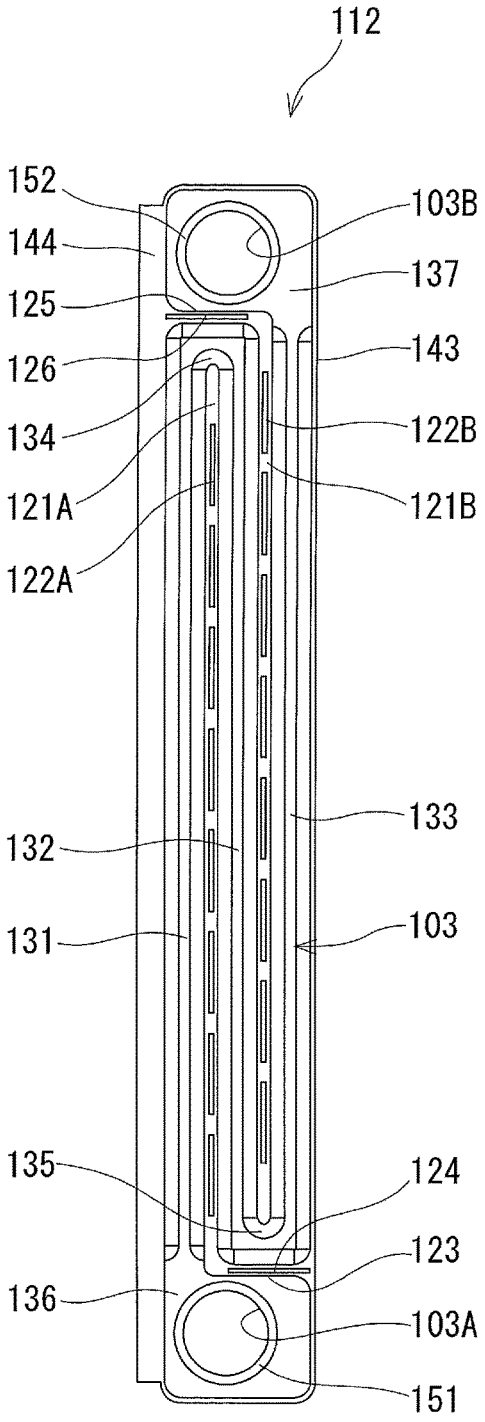
FIG. 8B is a plan view of the second plate member of the first heat exchange tube of FIG. 7A.
Figure 8C:
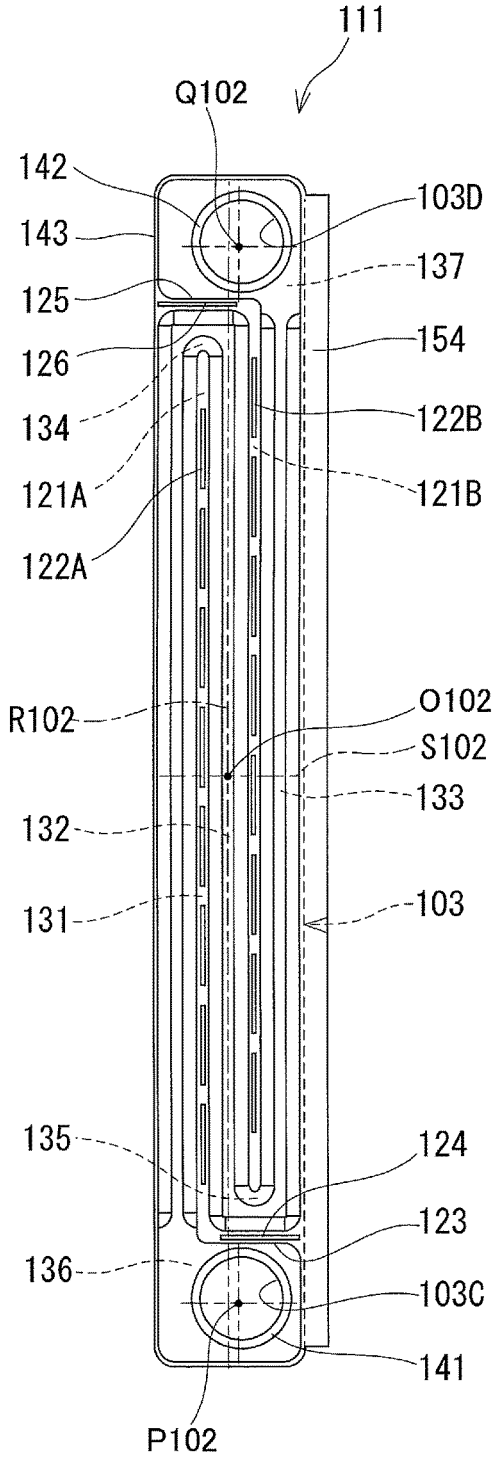
FIG. 8C is a plan view of the first plate member of the second heat exchange tube of FIG. 7B.
Figure 8D:
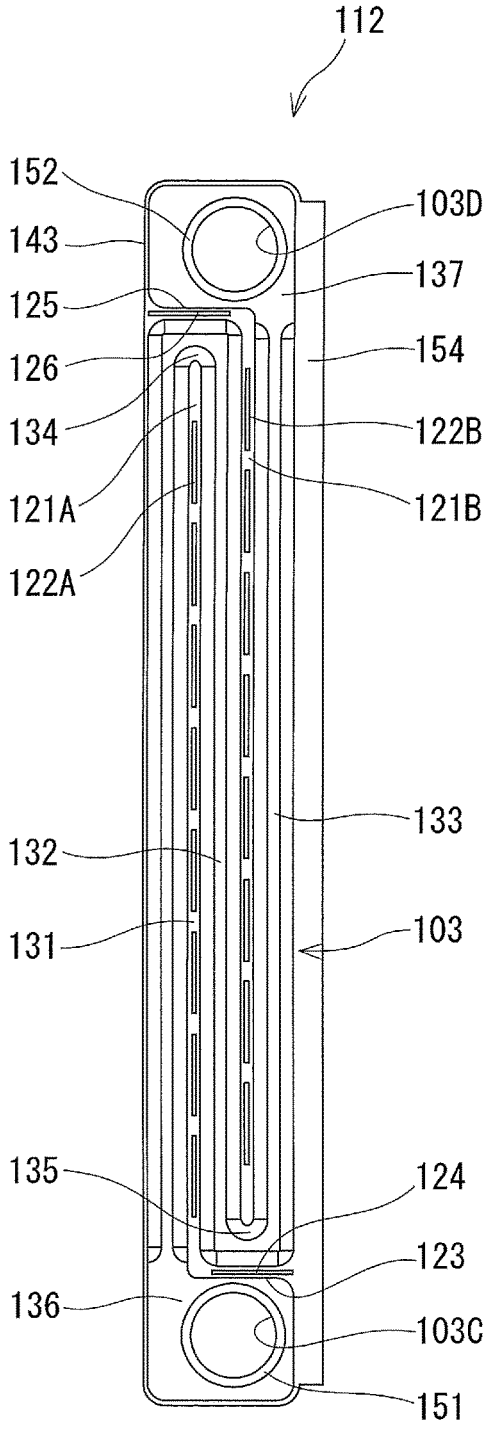
FIG. 8D is a plan view of the second plate member of the second heat exchange tube of FIG. 7B.

In the present embodiment, the heat exchange tubes 2 are directly joined to each other. As shown in FIG. 2C, two adjacent ones of the heat exchange tubes 2 are defined as a first heat exchange tube 2A and a second heat exchange tube 2B, respectively. FIG. 2A shows the first plate member 11 of the first heat exchange tube 2A and the second plate member 12 of the first heat exchange tube 2A. FIG. 2B shows the first plate member 11 of the second heat exchange tube 2B and the second plate member 12 of the second heat exchange tube 2B. FIG. 2C shows the first plate member 11 of the first heat exchange tube 2A and the second plate member 12 of the second heat exchange tube 2B. The first heat exchange tube 2A and the second heat exchange tube 2B have the same structure as each other. As shown in FIG. 2C, the second heat exchange tube 2B is in a position rotated 180 degrees from that of the first heat exchange tube 2A. As shown in FIG. 5 and FIG. 6, the first heat exchange tubes 2A are located at odd-numbered positions from the heat exchange tube 2 forming an end face of the heat exchanger 1, while the second heat exchange tubes 2B are positioned at even-numbered positions from the heat exchange tube 2 forming the end face.

Figure 3C:
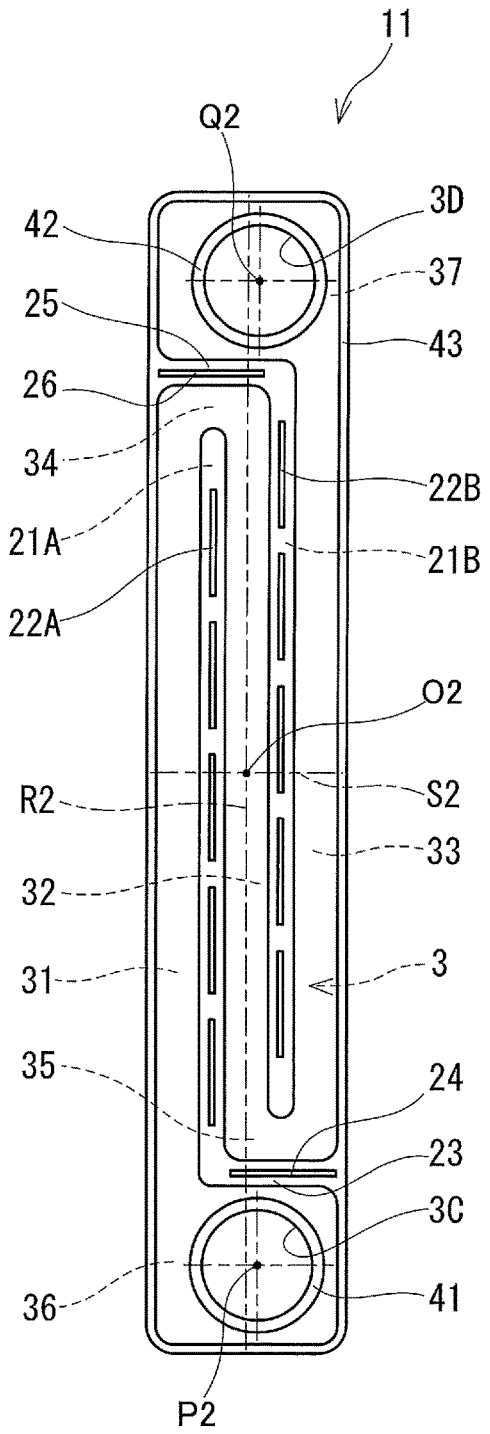
FIG. 3C is a plan view of the first plate member of the second heat exchange tube of FIG. 2B.
Figure 3D:
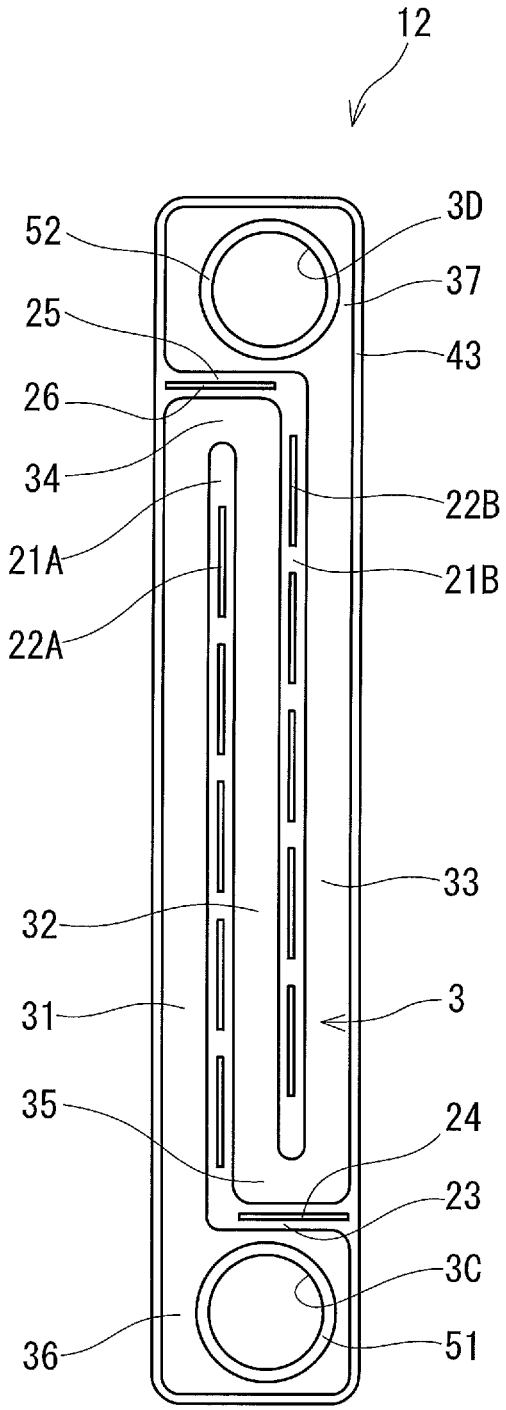
FIG. 3D is a plan view of the second plate member of the second heat exchange tube of FIG. 2B.
Figure 3E:
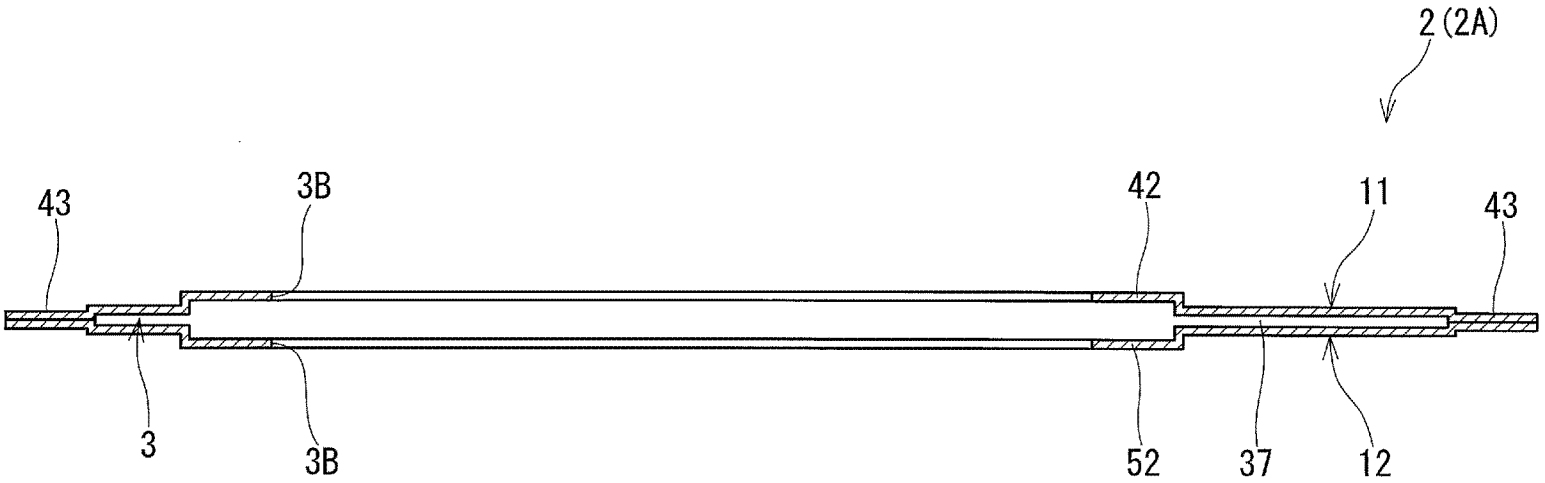
FIG. 3E is a cross-sectional view of the first heat exchange tube of FIG. 2A taken along the line IIIE-IIIE.

As shown in FIG. 3A, the inlet 3A and the outlet 3B of the internal flow path 3 of the first heat exchange tube 2A are located symmetrically with respect to a center line S1 in the longitudinal direction of the heat exchange tube 2. A center P1 of the inlet 3A and a center Q1 of the outlet 3B are offset widthwise from a center line R1 in the width direction of the heat exchange tube 2. As shown in FIG. 3C, an inlet 3C and an outlet 3D of the internal flow path 3 of the second heat exchange tube 2B are located symmetrically with respect to a center line S2 in the longitudinal direction of the heat exchange tube 2. A center P2 of the inlet 3C and a center Q2 of the outlet 3D are offset widthwise from a center line R2 in the width direction of the heat exchange tube 2. The second heat exchange tube 2B is in a position rotated 180 degrees from that of the first heat exchange tube 2A shown in FIG. 3A around a center point O1. The center point O1 is a point of intersection between the center line S1 and the center line R1. A center point O2 of the second heat exchange tube 2B shown in FIG. 3C is located at the same position as the center point O1 of the first heat exchange tube 2A. That is, when orthographically projected in the direction in which the heat exchange tubes 2 are arranged, the center point O1 coincides with the center point O2. The center point O2 is a point of intersection between the center line S2 and the center line R2. The configuration of the internal flow path 3 of the second heat exchange tube 2B is the same as the configuration of the internal flow path 3 of the first heat exchange tube 2A, and therefore is not described in detail.

Figure 4A:
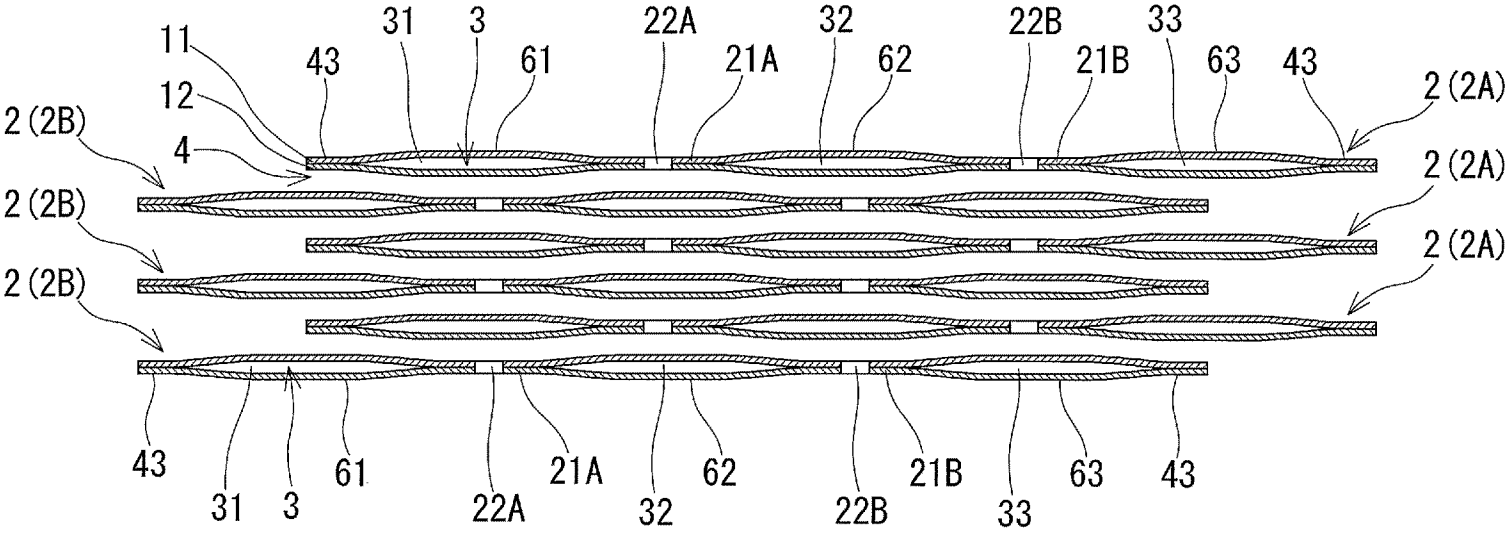
FIG. 4A is a cross-sectional view of the first heat exchange tube of FIG. 2A and the second heat exchange tube of FIG. 2B which is taken along the line IV-IV.

As shown in FIG. 3A to FIG. 3D and as described above, the internal flow path 3 has the first segment 31, the second segment 32, and the third segment 33 which extend in the row direction. As shown in FIG. 4A, the heat exchange tube 2 has a first flow path forming portion 61, a second flow path forming portion 62, and a third flow path forming portion 63. The first flow path forming portion 61 is a portion projecting to both sides in the thickness direction of the heat exchange tube 2 (to the upper and lower sides in FIG. 4A) and forming the first segment 31. Similarly, the second flow path forming portion 62 is a portion projecting to both sides in the thickness direction of the heat exchange tube 2 and forming the second segment 32. The third flow path forming portion 63 is a portion projecting to both sides in the thickness direction of the heat exchange tube 2 and forming the third segment 33. The first thin portion 21A is located between the first flow path forming portion 61 and the second flow path forming portion 62 which are adjacent to each other in the width direction of the heat exchange tube 2. The second thin portion 21B is located between the second flow path forming portion 62 and the third flow path forming portion 63 which are adjacent to each other in the width direction of the heat exchange tube 2.

As shown in FIG. 2C, the first projecting portion 41 of the first heat exchange tube 2A is joined to a portion around the inlet 3C of the second heat exchange tube 2B, and the second projecting portion 42 of the first heat exchange tube 2A is joined to a portion around the outlet 3D of the second heat exchange tube 2B. As shown in FIG. 4A, in a cross-section perpendicular to the longitudinal direction (raw direction) of the heat exchange tube 2, the first flow path forming portion 61 and the second flow path forming portion 62 for the internal flow path 3 of the first heat exchange tube 2A face the first thin portion 21A and the second thin portion 21B of the second heat exchange tube 2B, respectively, across the external flow path 4. The second flow path forming portion 62 and the third flow path forming portion 63 for the internal flow path 3 of the second heat exchange tube 2B face the first thin portion 21A and the second thin portion 21B of the first heat exchange tube 2A, respectively, across the external flow path 4. The first flow path forming portions 61, the second flow path forming portions 62, and the third flow path forming portions 63 of the first heat exchange tube 2A and the second heat exchange tube 2B are arranged in a staggered pattern in the width direction of the heat exchange tubes 2.

As shown in FIG. 2C, the first heat exchange tube 2A and the second heat exchange tube 2B are joined together so that the inlet 3C of the second heat exchange tube 2B communicates with the inlet 3A of the first heat exchange tube 2A and so that the outlet 3D of the second heat exchange tube 2B communicates with the outlet 3B of the first heat exchange tube 2A. It is assumed here that the second heat exchange tube 2B is rotated 180 degrees in a plane perpendicular to the thickness direction of the heat exchange tubes 2 so that the inlet 3C of the second heat exchange tube 2B communicates with the outlet 3B of the first heat exchange tube 2A and so that the outlet 3D of the second heat exchange tube 2B communicates with the inlet 3A of the first heat exchange tube 2A. Then, in the width direction of the heat exchange tubes 2, the positions of the first flow path forming portion 61 and the second flow path forming portion 62 of the first heat exchange tube 2A coincide with the positions of the first flow path forming portion 61, the second flow path forming portion 62, and the third flow path forming portion 63 of the second heat exchange tube 2B. Similarly, the positions of the first thin portion 21A and the second thin portion 21B of the first heat exchange tube 2A coincide with the positions of the first thin portion 21A and the second thin portion 21B of the second heat exchange tube 2B. With such a configuration, the same metal mold can be used for production of both the first heat exchange tube 2A and the second heat exchange tube 2B, and therefore the production cost of the heat exchange tubes 2 can be reduced.

As shown in FIG. 4A, in the cross-section perpendicular to the longitudinal direction of the heat exchange tubes 2, the space between the first heat exchange tube 2A and the second heat exchange tube 2B constitutes the external flow path 4 in which the second fluid flows. The external flow path 4 meanders gently from the inlet (upstream side) to the outlet (downstream side). Due to the meandering of the external flow path 4, the development of a boundary layer on the surfaces of the heat exchange tubes 2 is suppressed.

In addition, the surfaces of the first flow path forming portion 61, the second flow path forming portion 62, and the third flow path forming portion 63 extend from the first thin portion 21A and the second thin portion 21B in a direction inclined with respect to both the thickness direction and the width direction of the heat exchange tube 2. With such a configuration, separation of the second fluid from the surfaces of the flow path forming portions 61, 62, and 63 can be suppressed, so the heat exchange efficiency of the heat exchanger 1 is further improved. In other words, the thicknesses of the first flow path forming portion 61, the second flow path forming portion 62, and the third flow path forming portion 63 continuously increase and decrease in the flow direction of the second fluid.

In the cross-section shown in FIG. 4A, the surfaces of the flow path forming portions 61, 62, and 63 and the surfaces of the first thin portion 21A and the second thin portion 21B are connected to form curved lines. Similarly, the surfaces of the flow path forming portions 61 and 63 and the surface of the outer peripheral portion 43 are connected to form curved lines. The profiles of the flow path forming portions 61, 62, and 63 are formed by a combination of straight lines and curved lines smoothly connected to the straight lines. When the curved line and the straight line are connected so that the resulting profile has no point at which differentiation is not possible, the straight line and the curved line can be determined to be smoothly connected. With such a configuration, separation of the second fluid in the vicinity of the boundary between the outer peripheral portion 43 and the first flow path forming portion 61 can be suppressed. Similarly, separation of the second fluid in the vicinity of the boundary between the first flow path forming portion 61 and the first thin portion 21 can be suppressed. These effects are obtained also for the flow path forming portions 62 and 63 located on the downstream side. Consequently, the heat exchange efficiency of the heat exchanger 1 is further improved. The entire profiles of the flow path forming portions 61, 62, and 63 may be formed by curved lines alone. The profiles of the flow path forming portions 61, 62, and 63 may have a curved shape, such as a streamlined shape and a wing-like shape. The shapes of the profiles of the flow path forming portions 61, 62, and 63 are not limited to those which are formed by smoothly-connected curved lines.

In the cross-section shown in FIG. 4A, each of the flow path forming portions 61, 62, and 63 includes a one-side portion and an opposite-side portion which are divided from each other by the junction plane between the paired first and second plate members 11 and 12 in the heat exchange tube 2. The one-side portion is located closer to the first plate member 11 (the upper portion in FIG. 4A). The opposite-side portion is located closer to the second plate member 12 (the lower portion in FIG. 4A). The one-side portions of the flow path forming portions 61, 62, and 63 which are located closer to the first plate member 11, and the opposite-side portions of the flow path forming portions 61, 62, and 63 which are located closer to the second plate member 12, are symmetrical with respect to the junction plane. With such a configuration, the increase and decrease in width of the external flow path 4 can be further reduced. Consequently, the pressure loss of the second fluid flowing in the external flow path 4 can be further reduced.

In the present embodiment, the dimension of the external flow path 4 in the direction in which the heat exchange tubes 2 are arranged is approximately constant from the upstream end to the downstream end of the external flow path 4. In other words, the shapes of the flow path forming portions 61, 62, and 63 are adjusted so that the interval (minimum distance) between the first heat exchange tube 2A and the second heat exchange tube 2B is constant. With such a configuration, the pressure loss of the second fluid flowing in the external flow path 4 can be further reduced.

Figure 4B:
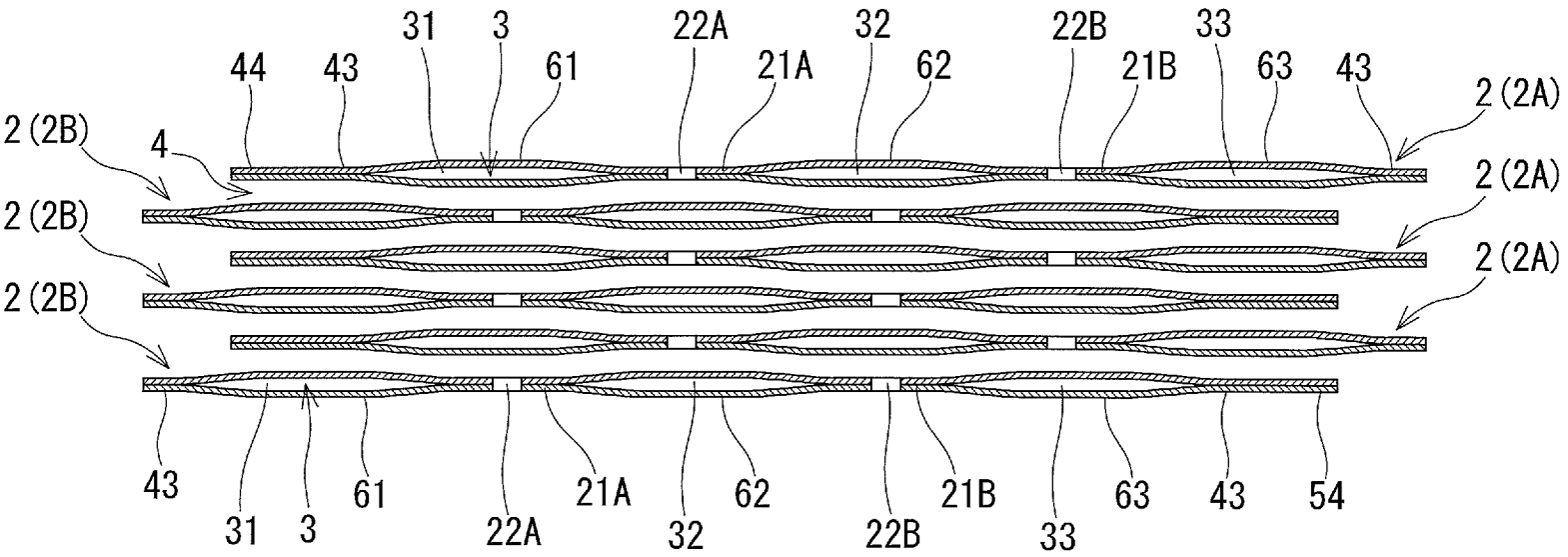
FIG. 4B is a cross-sectional view taken similarly to FIG. 4A and showing a heat exchange tube of a heat exchanger according to a modification of the present invention.

As shown in FIG. 4B, the heat exchange tubes 2 may further have a first plate-shaped portion 44 and a second plate-shaped portion 54. The first plate-shaped portion 44 is a portion provided in the first heat exchange tube 2A at one end in the width direction and projecting from the outer peripheral portion 43 in a direction parallel to the width direction. The second plate-shaped portion 54 is a portion provided in the second heat exchange tube 2B at the other end in the width direction and projecting from the outer peripheral portion 43 in a direction parallel to the width direction. With such a configuration, the first plate-shaped portion 44 and the second plate-shaped portion 54 function as heat transfer fins, so the heat exchange capacity of the heat exchanger 1 is increased. Additionally, the second plate-shaped portion 54 projects in the direction in which the second fluid flows. The second plate-shaped portion 54 can serve to suppress the separation of the second fluid at the other end of the second heat exchange tube 2B, thereby improving the heat exchange efficiency of the heat exchanger 1. Furthermore, these plate-shaped portions 44 and 54 enable efficient use of the volume occupied by the heat exchanger 1. The first plate-shaped portion 44 and the second plate-shaped portion 54 may project from the outer peripheral portion 43 on both sides in the width direction.

In the present embodiment, the width of the first plate-shaped portion 44 is twice the width of the outer peripheral portion 43. The width of the second plate-shaped portion 54 is twice the width of the outer peripheral portion 43. At one end in the width direction, the first plate-shaped portion 44 of the first heat exchange tube 2A is located so as not to extend beyond the outer peripheral portion 43 of the second heat exchange tube 2B. At the other end in the width direction, the second plate-shaped portion 54 of the second heat exchange tube 2B is located so as not to extend beyond the outer peripheral portion 43 of the first heat exchange tube 2A.

As shown in FIG. 2C, the first projecting portion 41 of the first heat exchange tube 2A is joined by brazing to a portion around the inlet 3C of the second heat exchange tube 2B. Specifically, the first projecting portion 41 of the first heat exchange tube 2A is joined by brazing to the third projecting portion 51 of the second heat exchange tube 2B. The second projecting portion 42 of the first heat exchange tube 2A is joined by brazing to a portion around the outlet 3D of the second heat exchange tube 2B. Specifically, the second projecting portion 42 of the first heat exchange tube 2A is joined by brazing to the fourth projecting portion 52 of the second heat exchange tube 2B. That is, the projecting portions of the adjacent heat exchange tubes 2 are joined together. The first heat exchange tube 2A is combined with the second heat exchange tube 2B via the first projecting portion 41 and the second projecting portion 42. The inlet 3A of the first plate member 11 of the first heat exchange tube 2A communicates with the inlet 3C of the second plate member 12 of the second heat exchange tube 2B. The outlet 3B of the first plate member 11 of the first heat exchange tube 2A communicates with the outlet 3D of the second plate member 12 of the second heat exchange tube 2B. With such a configuration, the weight of the heat exchanger 1 can be reduced, and the ease of assembly of the heat exchange tubes 2 can be improved, as compared with the case of providing a discrete hollow tube coupling the first heat exchange tube 2A and the second heat exchange tube 2B together.

It should be noted that the inlet 3C and the outlet 3D are not formed in the second plate member 12 of the heat exchange tube 2 forming the other end face of the heat exchanger 1 in the direction in which the heat exchange tubes 2 are arranged (the right end face in FIG. 1).

In the heat exchanger 1 of the present embodiment described thus far, the heat exchange tube 2 is constituted by the first plate member 11 and the second plate member 12 bonded together so as to form the internal flow path 3, which is why reduction in thickness of the heat exchange tube 1 can be achieved. This can result in size reduction of the heat exchanger 1. Additionally, the flow path forming portions 61, 62, and 63 of the first heat exchange tube 2A and the second heat exchange tube 2B are arranged in a staggered pattern in the width direction. With such a configuration, the increase and decrease in width of the external flow path 4 between the first heat exchange tube 2A and the second heat exchange tube 2B can be reduced, and the pressure loss of the second fluid flowing in the external flow path 4 can be reduced, as compared with the case where the flow path forming portions are not arranged in a staggered pattern.

Second Embodiment

Next, a heat exchanger according to a second embodiment of the present invention will be described with reference to FIG. 7A to FIG. 10. In the present embodiment, the components identical to those of the above embodiment are denoted by numbers obtained by adding 100 to the reference numerals used in the above embodiment, and descriptions of such identical components may be partially omitted. That is, the features described for the heat exchanger of the first embodiment can be applied to the present embodiment described below unless technical inconsistency occurs.

As shown in FIG. 7A to FIG. 7C, FIG. 8A to FIG. 8D, and FIG. 9, heat exchange tubes 102 have a first plate-shaped portion 144 and a second plate-shaped portion 154. The first plate-shaped portion 144 is a portion provided in a first heat exchange tube 102A at one end in the width direction (on the left in FIG. 7A, on the left in FIG. 8A, on the left in FIG. 8B, and on the left in FIG. 9) and projecting leftward from an outer peripheral portion 143 in a direction parallel to the width direction. The second plate-shaped portion 154 is a portion provided in a second heat exchange tube 102B at the other end in the width direction (on the right in FIG. 7B, on the right in FIG. 8C, on the right in FIG. 8D, and on the right in FIG. 9) and projecting rightward from the outer peripheral portion 143 in a direction parallel to the width direction.

Figure 9:
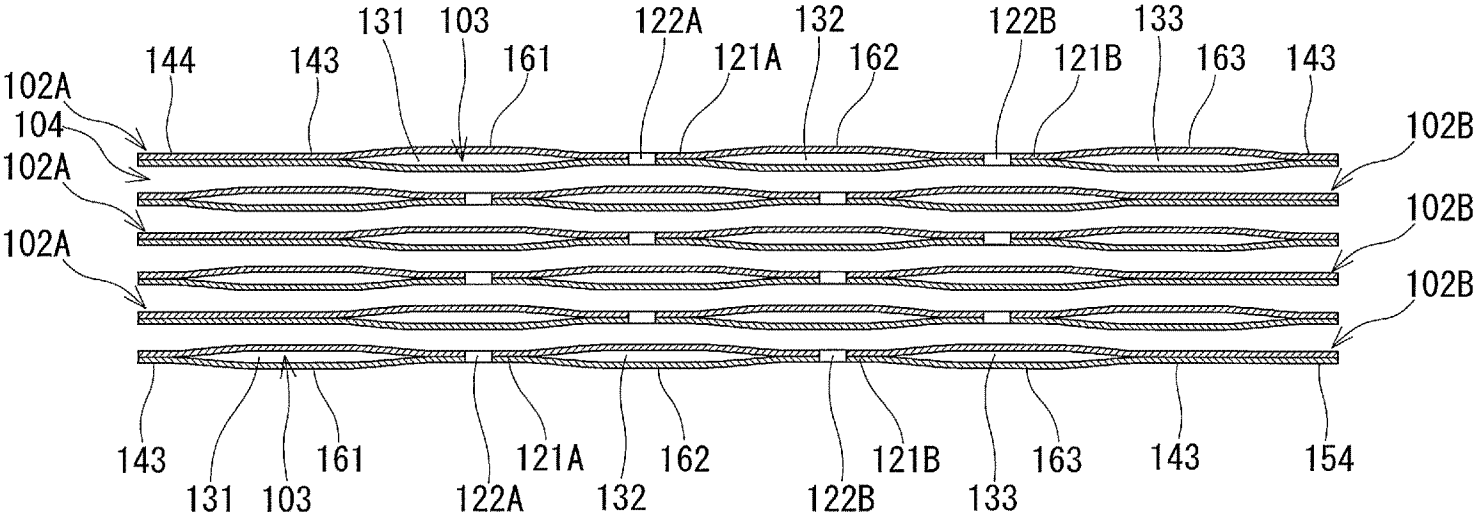
FIG. 9 is a cross-sectional view of the first heat exchange tube of FIG. 7A and the second heat exchange tube of FIG. 7B which is taken along the line IX-IX.
Figure 10:
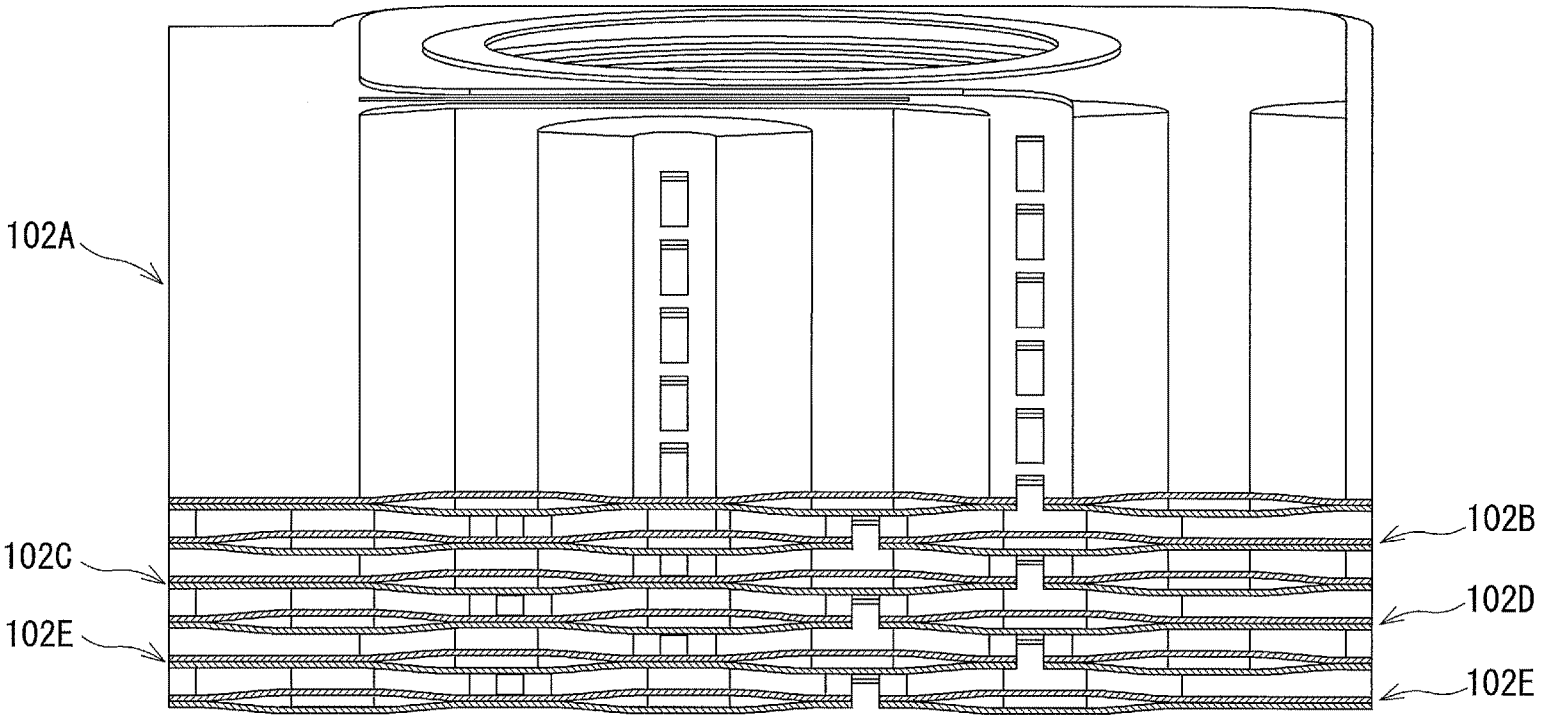
FIG. 10 is a partially cut-away perspective view of the heat exchange tube of the heat exchanger according to the second embodiment of the present invention.

As shown in FIG. 9 and FIG. 10, the width of the first plate-shaped portion 144 is three times the width of the outer peripheral portion 143. The width of the second plate-shaped portion 154 is three times the width of the outer peripheral portion 143. In the width direction, the edge of the first plate-shaped portion 144 at one end of the first heat exchange tube 102A is located at the same position as the edge of the outer peripheral portion 143 at one end of the second heat exchange tube 102B. In the width direction, the edge of the second plate-shaped portion 154 at the other end of the second heat exchange tube 102B is located at the same position as the edge of the outer peripheral portion 143 at the other end of the first heat exchange tube 102A.

With such a configuration, the first plate-shaped portion 144 and the second plate-shaped portion 154 function as heat transfer fins, so the heat exchange capacity of the heat exchanger is increased. Additionally, the second plate-shaped portion 154 projects in the direction in which the second fluid flows. The second plate-shaped portion 154 can serve to suppress the separation of the second fluid at the other end of the second heat exchange tube 102B, thereby improving the heat exchange efficiency of the heat exchanger. Furthermore, these plate-shaped portions 144 and 154 enable efficient use of the volume occupied by the heat exchanger. The first plate-shaped portion 144 and the second plate-shaped portion 154 may project from the outer peripheral portion 143 on both sides in the width direction.

Another Embodiment

Figure 11:
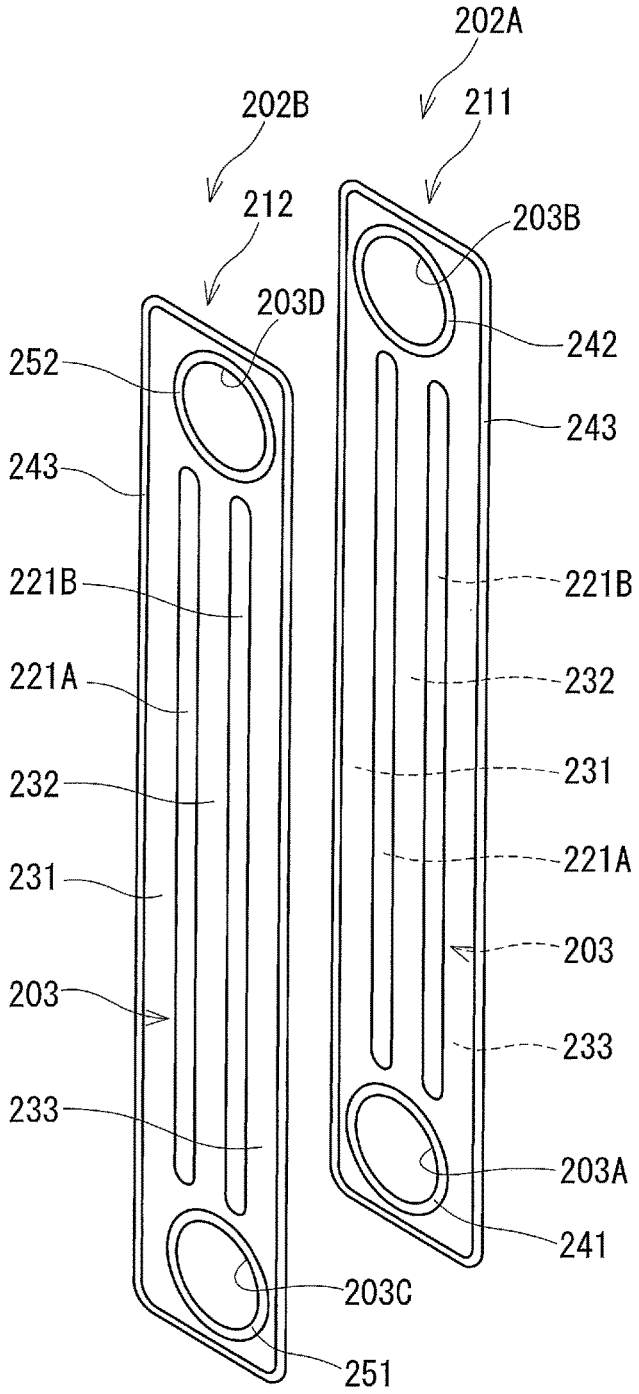
FIG. 11 is a perspective view of a first plate member of a first heat exchange tube and a second plate member of a second heat exchange tube which are included in a heat exchanger according to a modification of the present invention.

As shown in FIG. 11, an internal flow path 203 includes a first segment 231, a second segment 232, and a third segment 233 which extend in a row direction of the heat exchange tube 202. The segments 231, 232, and 233 each form a straight flow path. The flow of the first fluid is divided at an inlet 203A to streams flowing in the segments 231, 232, and 233, respectively. The streams of the first fluid flowing through the segments 231, 232, and 233 converge at an outlet 203B. As described thus far, the internal flow path 203 may be a straight flow path in which the flow direction of the first fluid from the inlet 203A to the outlet 203B is straight. By employing such a configuration, the structure of the heat exchange tube 202 is simplified, and therefore the production cost of the heat exchange tube 202 can be reduced.

The inhibitory structures that inhibit heat transfer are not limited to through holes. As such inhibitory structures, there may be provided the first thin portion 21A and the second thin portion 21B that are made of a material (e.g., a resin) having a lower thermal conductivity than the material (e.g., a metal) of the portions of the heat exchange tube 2 other than the first thin portion 21A and the second thin portion 21B.

INDUSTRIAL APPLICABILITY

The heat exchanger of the present invention is useful particularly as a heat exchanger of a vehicle air conditioner, a computer, an electrical household appliance, etc.

The invention claimed is:

1. A heat exchanger comprising a plurality of heat exchange tubes each comprising an internal flow path in which a first fluid flows, an inlet of the internal flow path, and an outlet of the internal flow path, the heat exchange tubes being assembled so as to form an external flow path for a second fluid to be heat-exchanged with the first fluid, wherein the internal flow path comprises a plurality of segments extending in a given row direction of the heat exchange tube, the heat exchange tube is constituted by a pair of plate members bonded together so as to form the internal flow path, the heat exchange tube further comprising: (i) a plurality of flow path forming portions projecting to both sides in a thickness direction of the heat exchange tube and respectively forming the segments of the internal flow path; (ii) a thin portion located between the flow path forming portions adjacent to each other in a width direction orthogonal to the row direction, the thin portion separating the segments of the internal flow path from each other along the row direction; (iii) a first projecting portion formed around the inlet of the internal flow path and projecting in the thickness direction of the heat exchange tube; and (iv) a second projecting portion formed around the outlet of the internal flow path and projecting in the thickness direction of the heat exchange tube, when two adjacent ones of the heat exchange tubes are defined as a first heat exchange tube and a second heat exchange tube, respectively, the first projecting portion of the first heat exchange tube is joined to a portion around the inlet of the second heat exchange tube, and the second projecting portion of the first heat exchange tube is joined to a portion around the outlet of the second heat exchange tube, in a cross-section perpendicular to the row direction, the flow path forming portion of the first heat exchange tube faces the thin portion of the second heat exchange tube across the external flow path, and the flow path forming portion of the second heat exchange tube faces the thin portion of the first heat exchange tube across the external flow path, the flow path forming portions of the first heat exchange tube and the second heat exchange tube are arranged in a staggered pattern in the width direction, the heat exchange tubes have the same structure as each other, assuming that the second heat exchange tube is rotated 180 degrees in a plane perpendicular to the thickness direction of the heat exchange tube so that the inlet of the second heat exchange tube communicates with the outlet of the first heat exchange tube and so that the outlet of the second heat exchange tube communicates with the inlet of the first heat exchange tube, then, in the width direction, positions of the flow path forming portions and the thin portion of the first heat exchange tube coincide with positions of the flow path forming portions and the thin portion of the second heat exchange tube, the internal flow path is a serpentine flow path in which a flow direction of the first fluid is reversed between the inlet and the outlet, the plurality of segments comprises a first segment and a second segment in which the first fluid flows in a direction opposite to a flow direction of the first fluid in the first segment, the internal flow path further comprises a curve segment connecting the first segment to the second segment, and the number of the plurality of segments is an odd number.

2. The heat exchanger according to claim 1, wherein the heat exchange tube has a rectangular shape in plan view, and the heat exchange tube is provided with a pair of opening portions which are respectively formed as the inlet and the outlet at one end and the other end in a longitudinal direction of the heat exchange tube in such a manner as to penetrate through the heat exchange tube in the thickness direction.

3. The heat exchanger according to claim 1, wherein the heat exchange tube further comprises a plate-shaped portion provided at at least one selected from one end and the other end in the width direction, the plate-shaped portion projecting in a direction parallel to the width direction.

4. The heat exchanger according to claim 1, wherein, in the cross-section perpendicular to the row direction, a surface of the flow path forming portion extends from the thin portion in a direction inclined with respect to both the thickness direction and the width direction of the heat exchange tube.

5. The heat exchanger according to claim 1, wherein, in the cross-section perpendicular to the row direction, a surface of the flow path forming portion and a surface of the thin portion are connected to form a curved line.

6. The heat exchanger according to claim 1, wherein, in the cross-section perpendicular to the row direction, (i) a profile of the flow path forming portion is formed by a curved line or (ii) a profile of the flow path forming portion is formed by a combination of a straight line and a curved line smoothly connected to the straight line.

7. The heat exchanger according to claim 1, wherein, in the cross-section perpendicular to the row direction, the flow path forming portion comprises a one-side portion and an opposite-side portion which are divided from each other by a junction plane between the paired plate members in the heat exchange tube, and the one-side portion and the opposite-side portion are symmetrical with respect to the junction plane.

8. The heat exchanger according to claim 1, wherein the heat exchange tube further comprises an inhibitory structure that is provided in the thin portion and that inhibits heat transfer between the first fluid flowing in the first segment and the first fluid flowing in the second segment.

9. The heat exchanger according to claim 1, further comprising:

an inlet header joined to the first projecting portion of the heat exchange tube that forms an end face of the heat exchanger, the inlet header being adapted to feed the first fluid to the inlet of the internal flow path; and an outlet header joined to the second projecting portion of the heat exchange tube forming the end face of the heat exchanger, the outlet header being adapted to discharge the first fluid through the outlet of the internal flow path.

10. A heat exchanger comprising a plurality of heat exchange tubes each comprising an internal flow path in which a first fluid flows, an inlet of the internal flow path, and an outlet of the internal flow path, the heat exchange tubes being assembled so as to form an external flow path for a second fluid to be heat-exchanged with the first fluid, wherein the internal flow path comprises a plurality of segments extending in a given row direction of the heat exchange tube, the heat exchange tube is constituted by a pair of plate members bonded together so as to form the internal flow path, the heat exchange tube further comprising: (i) a plurality of flow path forming portions projecting to both sides in a thickness direction of the heat exchange tube and respectively forming the segments of the internal flow path; (ii) a thin portion located between the flow path forming portions adjacent to each other in a width direction orthogonal to the row direction, the thin portion separating the segments of the internal flow path from each other along the row direction; (iii) a first projecting portion formed around the inlet of the internal flow path and projecting in the thickness direction of the heat exchange tube; and (iv) a second projecting portion formed around the outlet of the internal flow path and projecting in the thickness direction of the heat exchange tube, when two adjacent ones of the heat exchange tubes are defined as a first heat exchange tube and a second heat exchange tube, respectively, the first projecting portion of the first heat exchange tube is joined to a portion around the inlet of the second heat exchange tube, and the second projecting portion of the first heat exchange tube is joined to a portion around the outlet of the second heat exchange tube, in a cross-section perpendicular to the row direction, the flow path forming portion of the first heat exchange tube faces the thin portion of the second heat exchange tube across the external flow path, and the flow path forming portion of the second heat exchange tube faces the thin portion of the first heat exchange tube across the external flow path, the flow path forming portions of the first heat exchange tube and the second heat exchange tube are arranged in a staggered pattern in the width direction, the internal flow path is a serpentine flow path in which a flow direction of the first fluid is reversed between the inlet and the outlet, the plurality of segments comprises a first segment and a second segment in which the first fluid flows in a direction opposite to a flow direction of the first fluid in the first segment, the internal flow path further comprises a curve segment connecting the first segment to the second segment and a most upstream segment in which the first fluid flows, the most upstream segment being formed upstream of the first segment around the inlet, the heat exchange tube further comprises: (i) a most upstream thin portion dividing the curve segment from the most upstream segment; and (ii) an upstream inhibitory structure that is provided in the most upstream thin portion and that inhibits heat transfer between the first fluid flowing in the curve segment and the first fluid flowing in the most upstream segment, and the upstream inhibitory structure is a through hole penetrating through the most upstream thin portion in a thickness direction of the paired plate members and is formed in a region of the most upstream thin portion that is closest to the inlet.

11. A heat exchanger comprising a plurality of heat exchange tubes each comprising an internal flow path in which a first fluid flows, an inlet of the internal flow path, and an outlet of the internal flow path, the heat exchange tubes being assembled so as to form an external flow path for a second fluid to be heat-exchanged with the first fluid, wherein the internal flow path comprises a plurality of segments extending in a given row direction of the heat exchange tube, the heat exchange tube is constituted by a pair of plate members bonded together so as to form the internal flow path, the heat exchange tube further comprising: (i) a plurality of flow path forming portions projecting to both sides in a thickness direction of the heat exchange tube and respectively forming the segments of the internal flow path; (ii) a thin portion located between the flow path forming portions adjacent to each other in a width direction orthogonal to the row direction, the thin portion separating the segments of the internal flow path from each other along the row direction; (iii) a first projecting portion formed around the inlet of the internal flow path and projecting in the thickness direction of the heat exchange tube; and (iv) a second projecting portion formed around the outlet of the internal flow path and projecting in the thickness direction of the heat exchange tube, when two adjacent ones of the heat exchange tubes are defined as a first heat exchange tube and a second heat exchange tube, respectively, the first projecting portion of the first heat exchange tube is joined to a portion around the inlet of the second heat exchange tube, and the second projecting portion of the first heat exchange tube is joined to a portion around the outlet of the second heat exchange tube, in a cross-section perpendicular to the row direction, the flow path forming portion of the first heat exchange tube faces the thin portion of the second heat exchange tube across the external flow path, and the flow path forming portion of the second heat exchange tube faces the thin portion of the first heat exchange tube across the external flow path, the flow path forming portions of the first heat exchange tube and the second heat exchange tube are arranged in a staggered pattern in the width direction, the internal flow path is a serpentine flow path in which a flow direction of the first fluid is reversed between the inlet and the outlet, the plurality of segments comprises a first segment and a second segment in which the first fluid flows in a direction opposite to a flow direction of the first fluid in the first segment, the internal flow path further comprises a curve segment connecting the first segment to the second segment and a most downstream segment in which the first fluid flows, the most downstream segment being formed downstream of the second segment around the outlet and, the heat exchange tube further comprises: (i) a most downstream thin portion dividing the curve segment from the most downstream segment; and (ii) a downstream inhibitory structure that is provided in the most downstream thin portion and that inhibits heat transfer between the first fluid flowing in the curve segment and the first fluid flowing in the most downstream segment, and the downstream inhibitory structure is a through hole penetrating through the most downstream thin portion in a thickness direction of the paired plate members and is formed in a region of the most downstream thin portion that is closest to the outlet.

* * * * *